US006014842A

United States Patent [19]

Matsubara

[11] Patent Number: 6,014,842

[45] Date of Patent: Jan. 18, 2000

[54] MODULAR UNITS, MODULAR STRUCTURES HAVING MODULAR UNITS, AND METHOD FOR CONSTRUCTING MODULAR STRUCTURES

[76] Inventor: Hideo Matsubara, 1-1-1001, Kita 5-jo Nishi 29-chome, Chuo-ku, Sapporo-shi, Hokkaido, Japan

[21] Appl. No.: 08/984,711

[22] Filed: Dec. 3, 1997

[30] Foreign Application Priority Data

Dec. 4, 1996 [JP] Japan ..... 8-340646

[51] Int. Cl.[7] ..... A63H 33/12; E04B 1/10

[52] U.S. Cl. ..... 52/79.12; 52/234; 52/270; 52/284; 52/285.2; 52/585.1; 446/123; 446/115

[58] Field of Search ..... 52/79.5, 79.9, 52/79.12, 223.7, 234, 270, 284, 285.1, 285.2, 286, 585.1, 745.13; 446/108, 112–115, 122, 123

[56] References Cited

U.S. PATENT DOCUMENTS 1,308,254 7/1919 Otto .
1,671,505 5/1928 Bemis .
2,258,156 10/1941 Cavalieri .
2,493,435 1/1950 Archambault .
3,004,364 10/1961 Benkelman .
3,080,674 3/1963 Amici ..... 52/286 X
3,236,014 2/1966 Edgar ..... 52/286 X
3,305,982 2/1967 Steele ..... 52/286 X
3,362,739 1/1968 Staeger et al. ..... 52/285.1
3,604,146 9/1971 Winer .
4,270,303 6/1981 Xanthopoulos et al. .
5,802,780 9/1998 Hammerschlag .

*Primary Examiner*—Robert Canfield
*Attorney, Agent, or Firm*—Adams & Wilks

[57] ABSTRACT

A modular unit system for constructing a modular structure comprises different modular unit sets each having a identical modular unit. The modular units of each modular unit set has connecting surfaces each for connection to a corresponding connecting surface of at least one other identical modular unit or to a corresponding connecting surface of one of the modular units of another of the modular unit sets to construct a modular structure, such as a building structure, having a predetermined configuration.

36 Claims, 25 Drawing Sheets

MODULAR UNITS, MODULAR STRUCTURES HAVING MODULAR UNITS, AND METHOD FOR CONSTRUCTING MODULAR STRUCTURES

BACKGROUND OF THE INVENTION

1. Field of the Invention

The present invention relates generally to modular construction systems and, more particularly, to construction systems which employ a plurality of connectable modular units which can be assembled by amateur builders to construct modular structures having various structural configurations, and to a method for constructing modular structures using the modular units.

2. Background Information

The construction of building structures has been primarily carried out by large professional construction companies and/or builders. Both skilled and unskilled labor has been required to employ the various conventional methods for construction of building structures, which increases the overall construction cost. Furthermore, due to the requirement for skilled labor, the construction of conventional building structures has not been able to be completely realized by amateur builders.

Moreover, the construction of conventional building structures often requires more than one worker for handling the various construction components due to their large size and weight. Additionally, the safety of construction workers is often compromised since most operations in conventional building construction methods must be carried out from the exterior of the building structures.

Many of the modern buildings are being constructed with modular units, which greatly facilitates the construction of the building by reducing costly amounts of skilled and unskilled labor as well as reducing the amount of construction time. However, these modular units are quite costly and not universally adaptable to a wide variety of applications.

SUMMARY OF THE INVENTION

The present invention is directed to a set of modular units, modular structures constructed of the modular units, and a method for constructing the modular structures, which overcome the foregoing drawbacks of the conventional art.

It is an object of the present invention to provide a set of modular units which is not expensive to manufacture and which is adaptable to a wide variety of modular structures.

Another object of the present invention is to provide a set of modular units which can be readily assembled by amateur builders to construct modular structures in a relatively short period of time.

Another object of the present invention is to provide a set of modular units each of which is of a configuration, size and weight so as to enable a single amateur builder with minimum amounts of skill to transport and manipulate the same during construction of modular structures.

Another object of the present invention is to provide a set of modular units which can be readily assembled by amateur builders to construct modular structures using only a minimum number of simple connection elements and which does not require special tools for the assembly.

Another object of the present invention is to provide a modular structure which utilizes modular units to provide a final framework capable of assuming nearly any shape or size.

Another object of the present invention is to provide a method of constructing a modular structure which reduces costly amounts of skilled and unskilled labor and which reduces the amount of construction time.

Another object of the present invention is to provide a modular building structure and a construction method therefor in which all of the assembly operations, except for the construction of a roof structure, can be performed from the interior of the building structure.

The foregoing and other objects of the present invention are carried out by a modular unit system comprising a plurality of generally different modular unit sets each having a plurality of identical modular units. The modular units of each modular unit set have connecting surfaces each for connection to a corresponding connecting surface of at least one other identical modular unit or to a corresponding connecting surface of one of the modular units of another of the modular unit sets to construct a modular structure having a predetermined configuration.

In another aspect, the present invention provides a modular structure construction comprising a plurality of generally different modular unit sets each having a plurality of identical modular units, the modular units of each modular unit set having connecting surfaces, and means interconnecting each connecting surface of each modular unit of each modular unit set to a corresponding connecting surface of at least one other identical modular unit or to a corresponding connecting surface of one of the modular units of another of the modular unit sets to define the modular structure.

In another aspect, the present invention provides a building system comprising a building having a foundation, a roof structure, a wall structure for supporting the roof structure, and a floor structure for supporting the wall structure on the foundation. The roof structure, the wall structure and the floor structure comprise a plurality of generally different modular unit sets each having a plurality of identical modular units, the modular units of each modular unit set having connecting surfaces each for connection to a corresponding connecting surface of at least one other identical modular unit or to a corresponding connecting surface of one of the modular units of another of the modular unit sets to define the roof structure, the wall structure and the floor structure.

In one embodiment of the foregoing aspects of the present invention, the modular units of four of the different modular unit sets respectively comprise blocks having a generally I-shaped outline, a generally L-shaped outline, a generally T-shaped outline and a generally X-shaped outline.

In another embodiment of the foregoing aspects of the present invention, each modular unit of each modular unit set comprises at least one quadrilateral section having a first pair of parallel, spaced-apart members, and a second pair of parallel, spaced-apart members each having an end connected to an end of one of the first pair of members. Preferably, the first and second members of each quadrilateral section have the same cross-sectional shape such as, for example, square.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
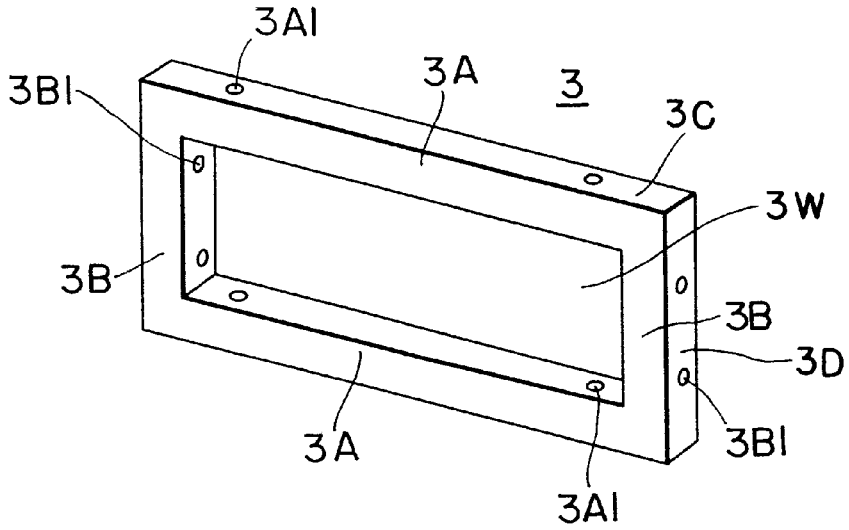
FIG. 1 is a perspective view of an I-shaped block utilized in a modular structure according to the present invention.

The present invention relates generally to modular units, modular structures constructed of the modular units, and methods for constructing the modular structures. For illustrative purposes only, the present invention will be described with reference to modular building structures, it being understood that the particular application to building structures and the configurations thereof shown are for illustrative purposes only and merely represent several of the multitude of different types of modular structures and configurations thereof that can be realized according to the present invention. Thus the present invention is in no way limited or restricted to the particular modular structures and configurations illustrated in the drawings.

As used throughout the specification and claims, the term "modular unit" refers to and means a single structural component which may be formed as a unitary structure from a single piece of material, or which may be formed of two or more pieces of material integrated together to form a single block unit. The term "block" refers to and means a structure or support having components which are formed of a solid material and which may be formed of a single piece of solid material or two or more pieces of solid materials integrated together. The term "modular structure" refers to and means a structure which is constructed from a plurality of modular units and which may be constructed in a wide variety of structural forms. For example, the modular units can be connected together in the form of a building structure, a transport system (e.g., container structure), or a bridge structure.

Moreover, certain terminology is used in the following description for convenience only and is not intended to be limiting. For purposes of this description, the terms "vertical" and "horizontal" are merely illustrative of relative space positions of the various components in the drawings. In actual practice, it is apparent that the components can be aligned in either orientation. Moreover, the terms "upper", "lower", "front", "rear", "left", "right", "inner" and "outer" designate directions in the drawing to which reference is made. Such terminology includes the terms above specifically mentioned and words of similar import.

Figure 9:
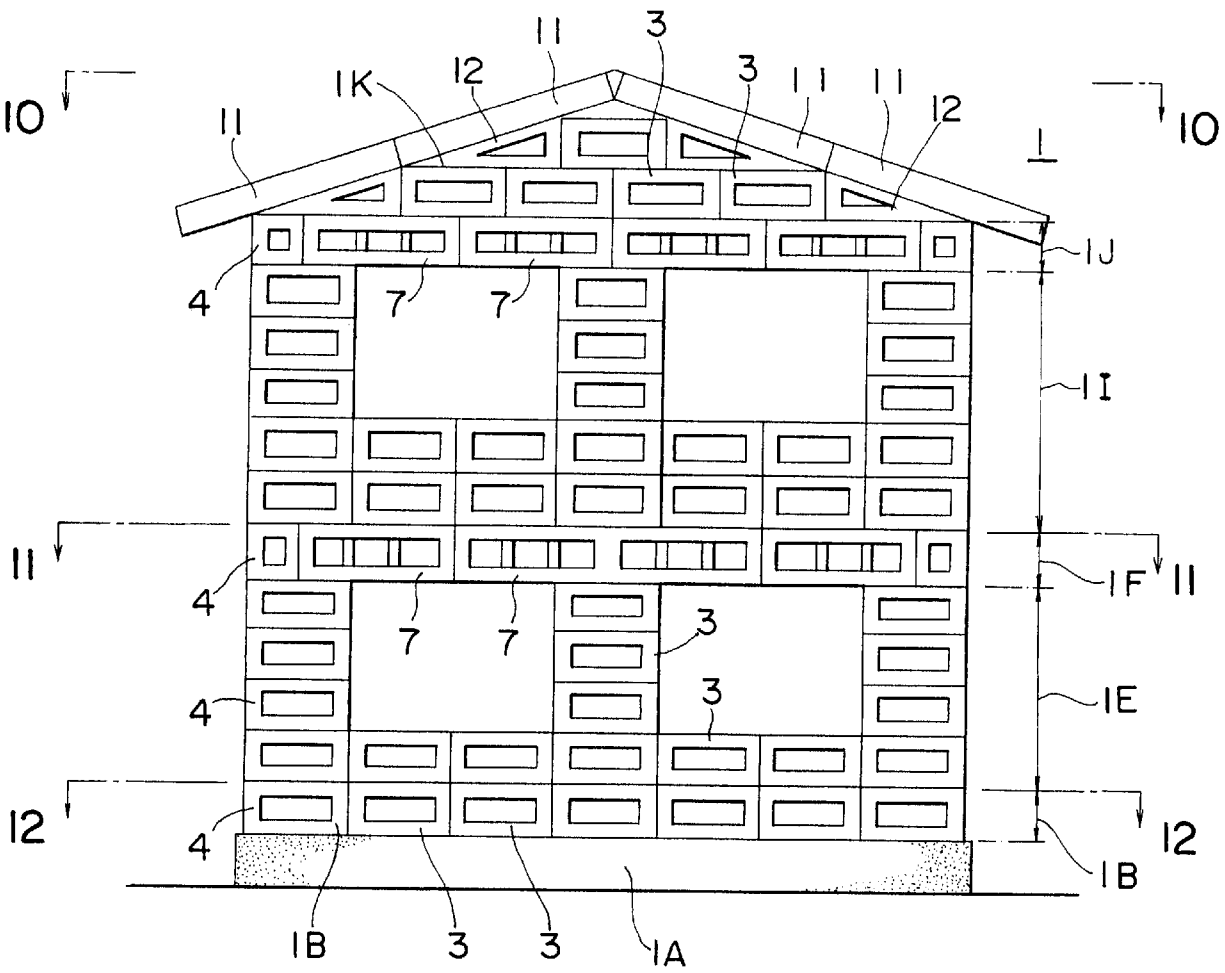
FIG. 9 is a front view of a modular building structure according to the present invention.
Figure 24:
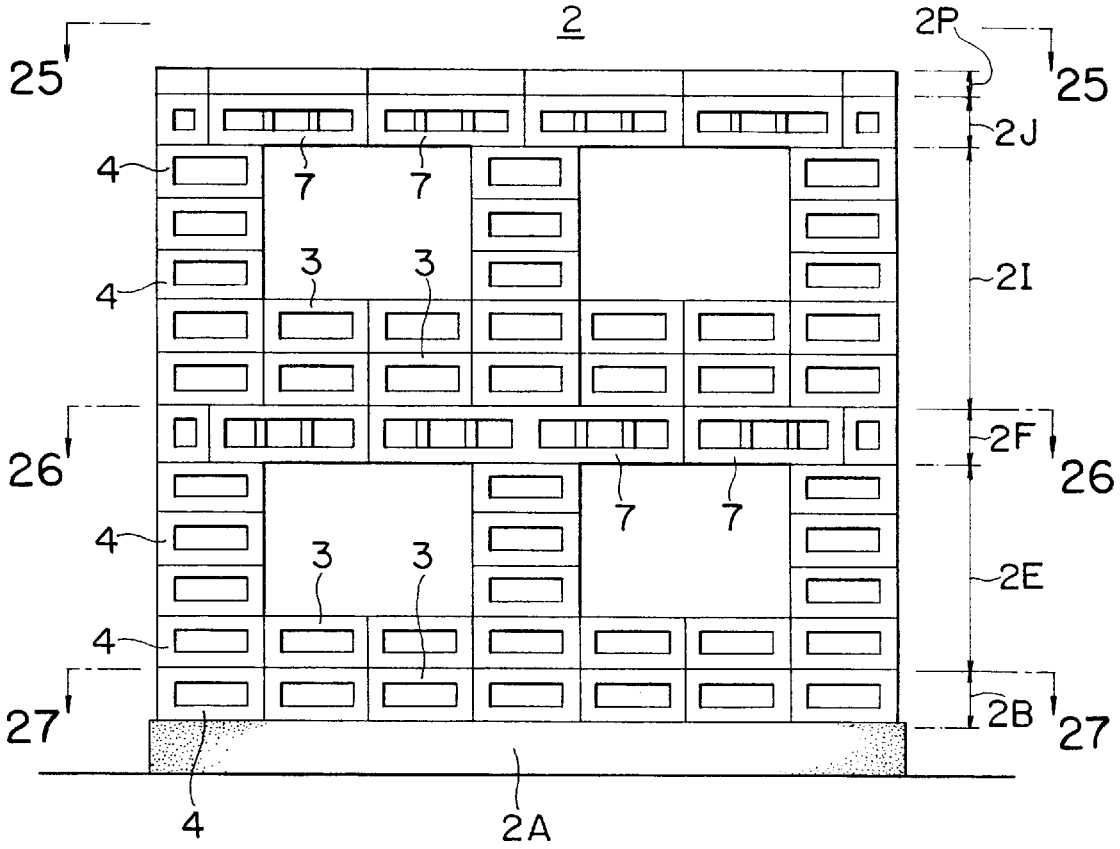
FIG. 24 is a front view of a modular building structure according to another embodiment of the present invention.

FIGS. 9 and 24 show modular structures 1 and 24, respectively, according to the present invention in the form of modular building structures. The modular building structures comprise a plurality of modular units which can be connected together by amateur builders having relatively low construction skills to construct the modular building structures.

FIGS. 1–8 show the modular units for constructing modular structures according to the present invention. As shown in FIG. 1, a first modular unit 3 comprises a block having a pair of parallel, spaced-apart upper and lower members 3A and a pair of parallel, spaced-apart transverse or vertical members 3B connecting the upper and lower members in spaced-apart relation. The vertical members 3B are each connected to respective ends of the upper and lower members 3A in perpendicular relation thereto, thereby defining a block having a generally rectangular open structure having an opening 3W. When viewed from above in FIG. 1, the first modular unit 3 has a generally I-shaped configuration. A plurality of vertical connecting through-holes 3A1 are formed on upper and lower connecting surfaces 3C of the upper and lower members 3A near the ends thereof, and a plurality of horizontal connecting through-holes 3B1 are formed on vertical connecting surfaces 3D of the vertical members 3B near the ends thereof for connecting the first modular unit 3 to other modular units and/or other structural components of the modular structure. Preferably, the I-shaped block is about 400 to 2,000 mm in length by about 300 to 1,000 mm in height.

Figure 2:
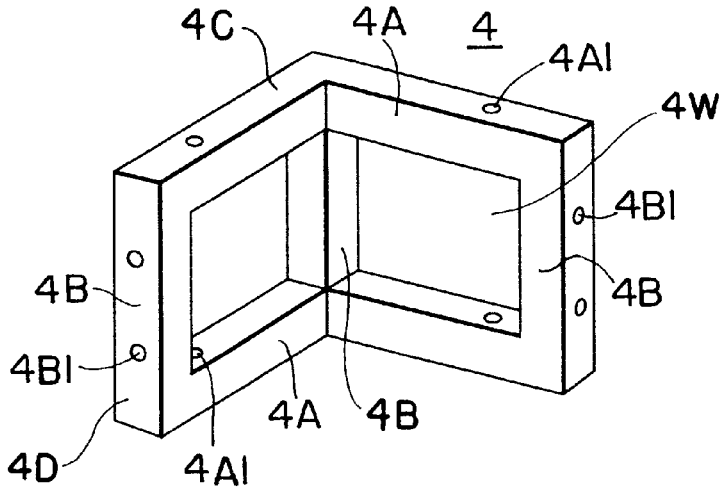
FIG. 2 is a perspective view of an L-shaped block utilized in a modular structure according to the present invention.

Referring now to FIG. 2, a second modular unit 4 according to the present invention comprises a block having a pair of parallel, spaced-apart upper and lower members 4A and a plurality of spaced-apart transverse or vertical members 4B connecting the upper and lower members in spaced-apart relation. In this embodiment, two of the vertical members 4B are each connected to respective ends of the upper and lower members 4A, and another vertical member 4B is connected to a central portion of each of the upper and lower members, thereby defining a block having an open structure having openings 4W. Each of the upper and lower members 4A comprises a pair of leg portions which are preferably perpendicular with respect to each other. When viewed from above in FIG. 2, the second modular unit 4 has a generally L-shaped configuration. A plurality of vertical connecting through-holes 4A1 are formed on upper and lower connecting surfaces 4C of the upper and lower members 4A near the ends thereof, and a plurality of horizontal connecting through-holes 4B1 are formed on vertical connecting surfaces 4D of the vertical members 4B near the ends thereof for connecting the second modular unit 4 to other modular units and/or other structural components of the modular structure.

Preferably, the length of the connecting surfaces of the second modular unit 4 is equal to the length of the connecting surfaces of the first modular unit 3. As used in this specification, the term "length" refers to and means the measurement of the extent of the connecting surface along its greatest dimension. The connecting through-holes of the first modular unit 3 and the connecting through-holes of the second modular unit 4 are formed at predetermined positions on the connecting surfaces such that when the respective connecting surfaces are superimposed for connection thereof, the connecting through-holes formed on the respective connecting surfaces are automatically aligned to allow passage therethrough of connecting elements for connecting the first and second modular units to each other. Preferably, the combined length of the connecting portions of the connecting surface 4C of the modular unit 4 defining the L-shape is about 400 to 2,000 mm, and the height of the connecting surface 4D (i.e., height of L-shaped block) is about 300 to 1,000 mm.

Figure 3:
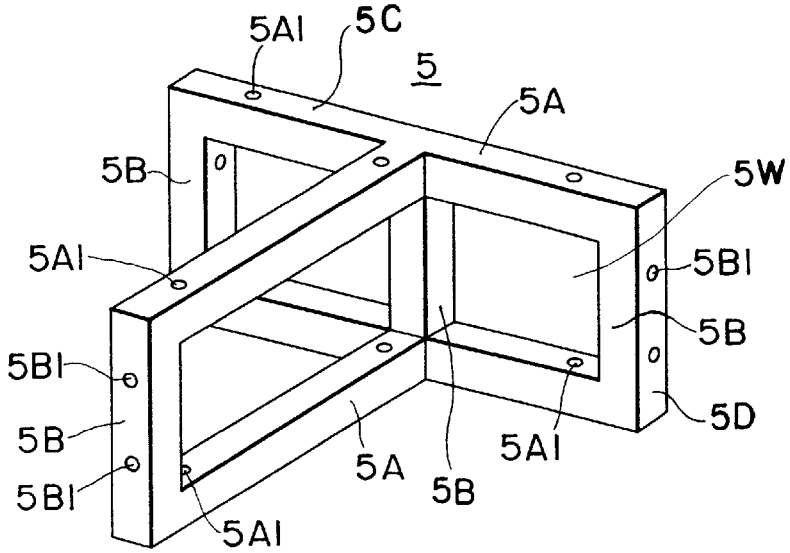
FIG. 3 is a perspective view of a T-shaped block utilized in a modular structure according to the present invention.

FIG. 3 shows the structure of a third modular unit 5 according to the present invention. The third modular unit 5 comprises a block having a pair of parallel, spaced-apart upper and lower members 5A and a plurality of spaced-apart transverse or vertical members 5B connecting the upper and lower members in spaced-apart relation. In this embodiment, three of the vertical members SB are each connected to respective ends of the upper and lower members 5A, and another vertical member 5B is connected to a central portion of each of the upper and lower members, thereby defining a block having an open structure having openings 5W. Each of the upper and lower members 5A comprises a pair of leg portions which are preferably perpendicular with respect to each other. When viewed from above in FIG. 3, the third modular unit 5 has a generally T-shaped configuration.

A plurality of vertical connecting through-holes 5A1 are formed on upper and lower connecting surfaces 5C of the upper and lower members 5A near the ends thereof, and a plurality of horizontal connecting through-holes 5B1 are formed on vertical connecting surfaces 5D of the vertical members 5B near the ends thereof for connecting the third modular unit 5 to other modular units and/or other structural components of the modular structure. Preferably, the length of the connecting surfaces of the third modular unit 5 is equal to the length of the connecting surfaces of the first modular unit 3 and the length of the connecting surfaces of the second modular unit 4. The connecting through-holes of the third modular unit 5 are formed at predetermined positions on the connecting surfaces similar to the positions described above for the connecting through-holes formed on the connecting surfaces of the first and second modular units. By this construction, when the connecting surfaces of the third modular unit 5 are superimposed with connecting surfaces of the first or second modular unit, the connecting through-holes formed on the respective connecting surfaces are automatically aligned to allow passage therethrough of connecting elements for connecting the third modular unit to the first or second modular unit. Preferably, the length of the connecting surface portion of the connecting surface 5C of each portion of the modular unit 5 defining the T-shape is about 400 to 2,000 mm, and the height of the connecting surface 5D (i.e., height of L-shaped block) is about 300 to 1,000 mm.

Figure 4:
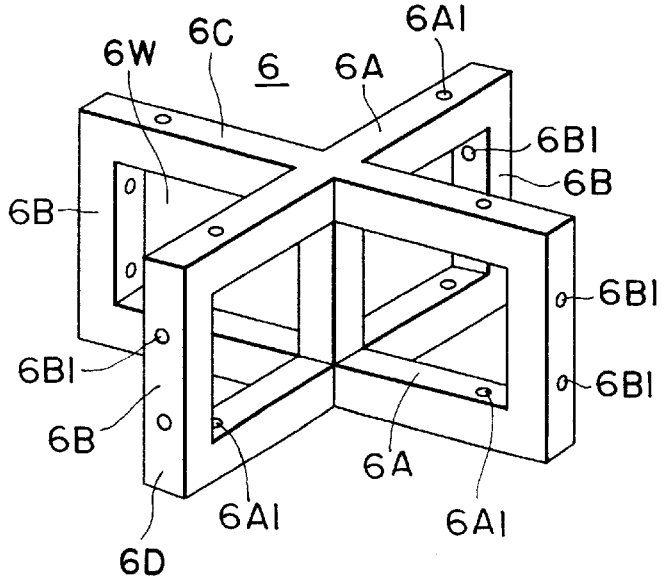
FIG. 4 is a perspective view of an X-shaped block utilized in a modular structure according to the present invention.

Referring now to FIG. 4, a fourth modular unit 6 according to the present invention comprises a block having a pair of parallel, spaced-apart upper and lower members 6A and a plurality of spaced-apart transverse or vertical members 6B connecting the upper and lower members in spaced-apart relation. In this embodiment, four of the vertical members 6B are each connected to respective ends of the upper and lower members 6A, and another vertical member 6B is connected to a central portion of each of the upper and lower members, thereby defining a block having an open structure having openings 6W. Each of the upper and lower members 6A comprises four leg portions which are preferably perpendicular with respect to each other. When viewed from above in FIG. 4, the fourth modular unit 6 has a generally X-shaped configuration.

A plurality of vertical connecting through-holes 6A1 are formed on upper and lower connecting surfaces 6C of the upper and lower members 6A near the ends thereof, and a plurality of horizontal connecting through-holes 6B1 are formed on vertical connecting surfaces 6D of the vertical members 6B near the ends thereof for connecting the fourth modular unit 6 to other modular units and/or other structural components of the modular structure. Preferably, the length of the connecting surfaces of the fourth modular unit 6 is equal to the length of the connecting surfaces of the first, second and third modular units 3–5. The connecting through-holes of the fourth modular unit 6 are formed at predetermined positions on the connecting surfaces similar to the positions described above for the connecting through-holes formed on the vertical connecting surfaces of the first, second and third modular units. By this construction, when the connecting surfaces of the fourth modular unit 6 are superimposed with the connecting surfaces of the first, second or third modular units, the connecting through-holes formed on the respective connecting surfaces are automatically aligned to allow passage therethrough of connecting elements for connecting the fourth modular unit to the first, second or third modular unit. Preferably, the combined lengths of two of the four connecting surface portions of the connecting surface 6C of the modular unit 6 defining the X-shape is about 400 to 2,000 mm, and the height of the connecting surface 6D (i.e., height of L-shaped block) is about 300 to 1,000 mm.

Preferably, as shown in FIGS. 1–4 and described above, each of the first, second, third and fourth modular units 3–6 is constructed as a unitary structure from a single piece of solid structural material, such as wood. However, it is understood by those skilled in the art that the modular units 3–6 may be formed of structural materials other than wood. For example, structural materials including metals such as iron, steel, aluminum or the like, or any of a number of known plastic materials such as polystyrene, several of the vinyl chlorides, several of the polyacrylates and polymethacylates, and the like are suitable for the modular units 3–6.

Furthermore, although each of the first, second, third and fourth modular unit 3–6 is preferably formed as a unitary structure from a single piece of solid structural material, it is understood that each of the modular units may be formed of a plurality of pieces of solid structural material integrated together to form a single block unit, such as, for example, as shown in FIGS. 35–43. In the description which follows, the first, second, third and fourth modular units 3–6 will hereinafter be referred to as "I-shaped block", "L-shaped block", "T-shaped block" and "X-shaped block", respectively.

FIGS. 35–40 show various embodiments of I-shaped blocks 31–35 formed of a plurality of pieces of structural materials integrated together to form a single block unit.

Figure 35:
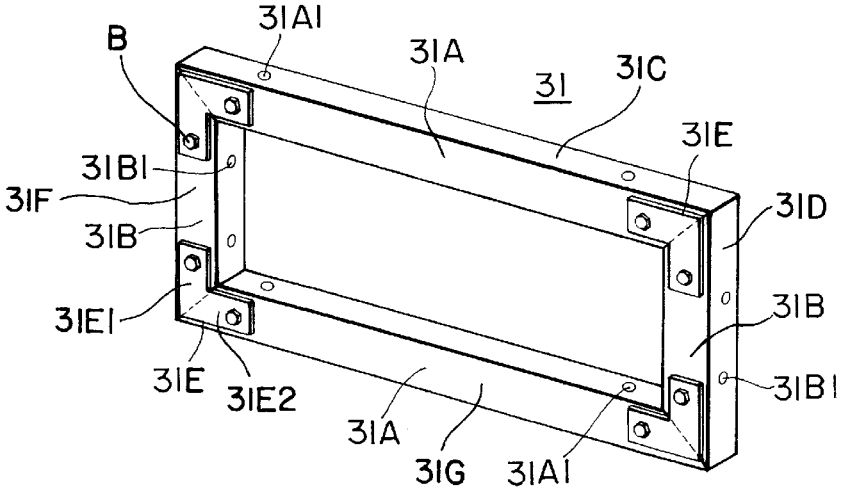
FIG. 35 is a perspective view of another embodiment of the I-shaped block according to the present invention.

As shown in FIG. 35, the I-shaped block 31 comprises a pair of parallel, spaced-apart upper and lower members 31A and a pair of parallel, spaced-apart transverse or vertical members 31B connecting the upper and lower members in spaced-apart relation. Each end of the vertical members 31B is preferably mitered at 45 degrees and is connected to a corresponding 45 degree mitered end of one of the upper or lower member 31A to provide four right angle corners defining the generally rectangular, open structure configuration of the I-shaped block 31. A plurality of vertical connecting through-holes 31A1 are formed on upper and lower connecting surfaces 31C of the upper and lower members 31A near the ends thereof, and a plurality of horizontal connecting through-holes 31B1 are formed on vertical connecting surfaces 31D of the vertical members 31B near the ends thereof for connecting the I-shaped block 31 to other modular units and/or other structural components of the modular structure.

The ends of the upper and lower members 31A and the ends of the vertical members 31B at each right angle corner are connected by connecting means 31E comprising a connecting member or plate having a pair of mutually perpendicular leg portions 31E1, 31E2. At each right angle corner, the leg portion 31E1 of the connecting plate 31E is connected to a surface 31F of the vertical member 31B and the leg portion 31E2 of the connecting plate 31E is connected to a surface 31G of the upper or lower member 31A. Preferably, the connecting member 31E is connected to the ends of the upper and lower members 31A and the vertical members 31B at each right angle corner by means of connecting elements, such as threaded bolts B, each extending through a through-hole formed in one of the leg portions 31E1, 31E2 of the connecting member and a through-hole formed proximate each end of the upper and lower members 31A and the vertical members 31B. The I-shaped block 31 is provided with connecting holes 31A1, 31B1 for connection to other modular units as described above for the I-shaped block 3 of FIG. 1.

FIGS. 36–40 show alternate embodiments of I-shaped blocks 32–35 which differ from the embodiment of FIG. 35 only in the structure of the connecting means for connecting the ends of the upper and lower members and the ends of the vertical members at each right angle corner.

Figure 36:
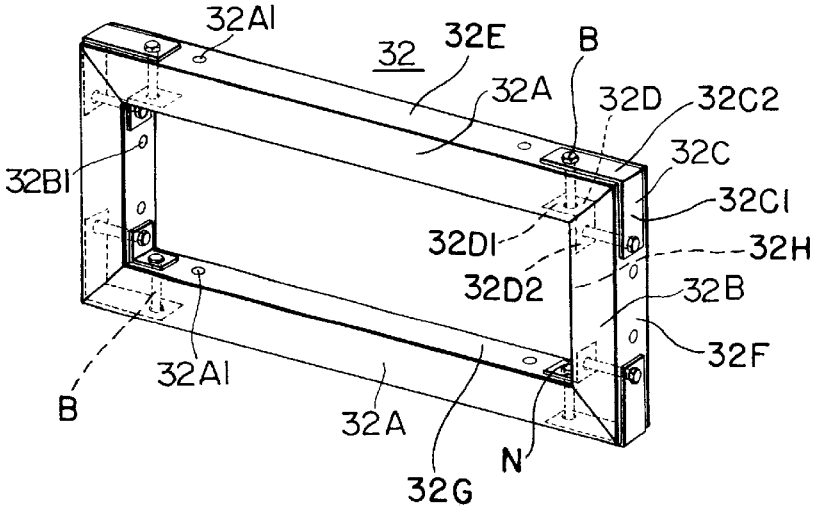
FIG. 36 is a perspective view of another embodiment of the I-shaped block according to the present invention.

In the embodiment of the I-shaped block 32 shown in FIG. 36, the connecting means comprises a first connecting member 32C having a pair of mutually perpendicular leg portions 32C1, 32C2, and a second connecting member 32D having a pair of mutually perpendicular leg portions 32D1, 32D2. At each right angle corner of the I-shaped block 32, the leg portions 32C1, 32C2 of one of the first connecting members 32C are connected to connecting surfaces 32E, 32F, respectively, of upper or lower member 32A and one of the vertical members 32B. Similarly, at each right angle corner, one of the second connecting members 32D is connected to inner surfaces 32G, 32H of the upper or lower member 32A and one of the vertical members 32B, respectively. At each right angle corner, the first and second connecting members 32C, 32D are connected to each other and to the upper or lower member and to one of the vertical members by connecting elements, such as threaded bolts B and threaded nuts N. Each of the threaded bolts B extends through a through-hole formed in one of the leg portions 32C1, 32C2 of the first connecting member 32C, a through-hole formed in the connecting surface 32E of the upper or lower member 32A and the connecting surface 32F of one of the vertical member 32B, and a through-hole formed in one of the leg portions 32D1, 32D2 of the second connecting member 32D, and is threaded to one of the nuts. The I-shaped block 32 is provided with connecting holes 32A1, 32B1 for connection to other modular units as described above for the I-shaped block 3 of FIG. 1.

Figure 37:
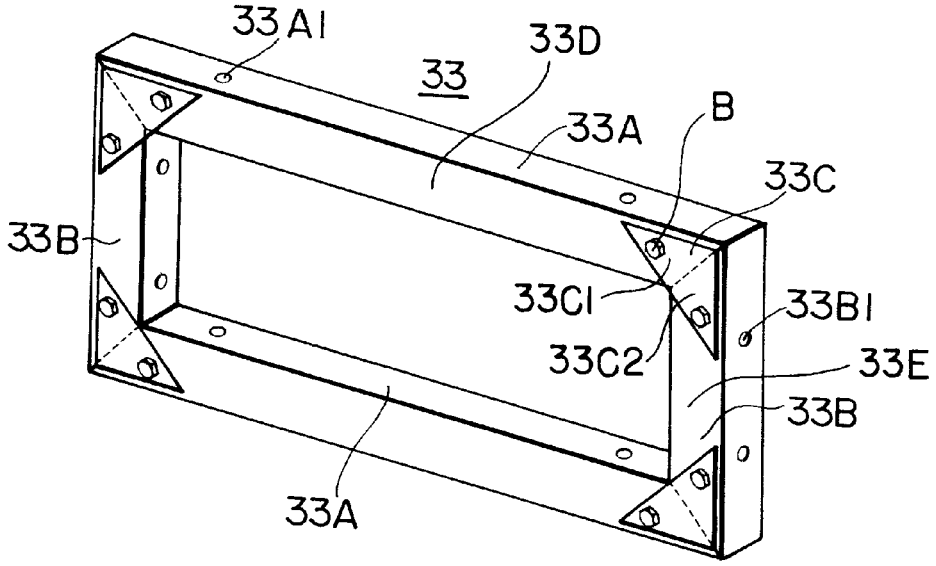
FIG. 37 is a perspective view of another embodiment of the I-shaped block according to the present invention.

Referring now to FIG. 37, the connecting means for the I-shaped block 33 comprises a plurality of generally triangular-shaped connecting members or plates 33C. In this particular embodiment, each connecting member 33C has the configuration of an isosceles triangle defining two right triangle portions 33C1, 33C2. At each right angle corner of the I-shaped block 33, the right triangle portions 33C1, 33C2 of one of the connecting members 33C are connected to connecting surfaces 33D, 33E of upper or lower member 33A and one of the vertical members 33B, respectively. At each right angle corner, one of the connecting members 33C is connected to the upper or lower member 33A and to one of the vertical members 33B by threaded bolts D. Each of the threaded bolts B extends through a through-hole formed in one of the right triangle portions 33C1, 33C2 of the connecting member 33C and a through-hole formed in the connecting surface 33D of the upper or lower member 33A and the connecting surface 33E of one of the vertical member 33B. The I-shaped block 33 is provided with connecting holes 33A1, 33B1 for connection to other modular units as described above for the I-shaped block 3 of FIG. 1.

Figure 38:
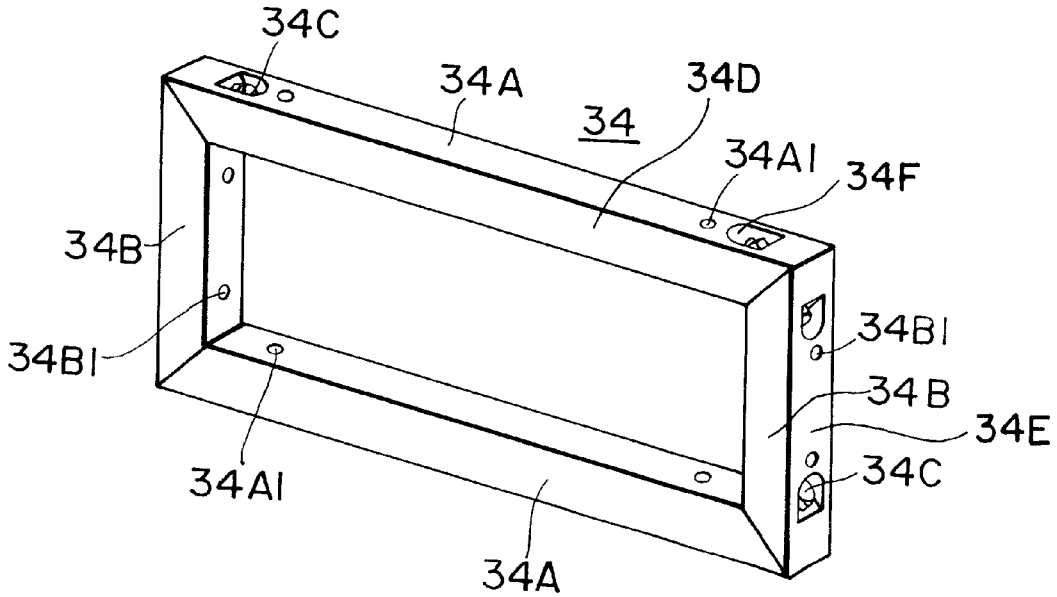
FIG. 38 is a perspective view of another embodiment of the I-shaped block according to the present invention.
Figure 39:
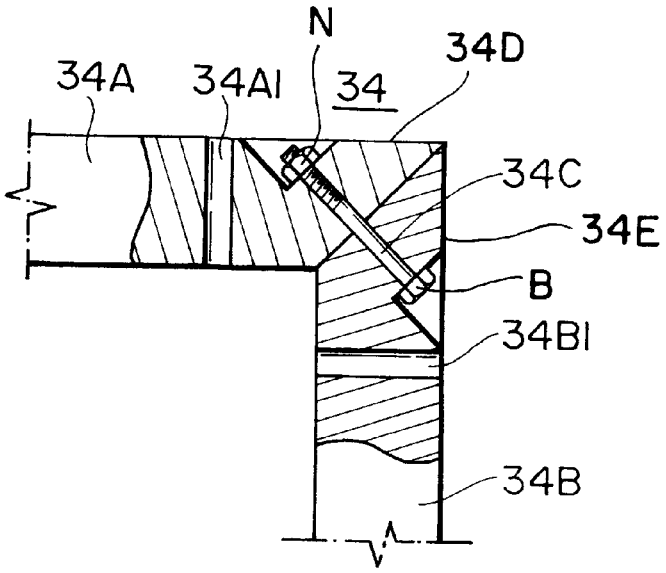
FIG. 39 is an enlarged view of a portion of the I-shaped block shown in FIG. 38.

In the embodiment of the I-shaped block 34 shown in FIGS. 38 and 39, the connecting means comprises a connecting assembly 34C comprised of threaded bolts B and threaded nuts N. At each right angle corner of the I-shaped block 34, one of the threaded bolts B extends through countersink holes 34F formed on connecting surfaces 34D, 34E of one of the upper or lower members 34A and one of the vertical members 34B and is secured by a threaded nut N. The I-shaped block 34 is provided with connecting holes 34A1, 34B1 for connection to other modular units as described above for the I-shaped block 3 of FIG. 1.

Figure 40:
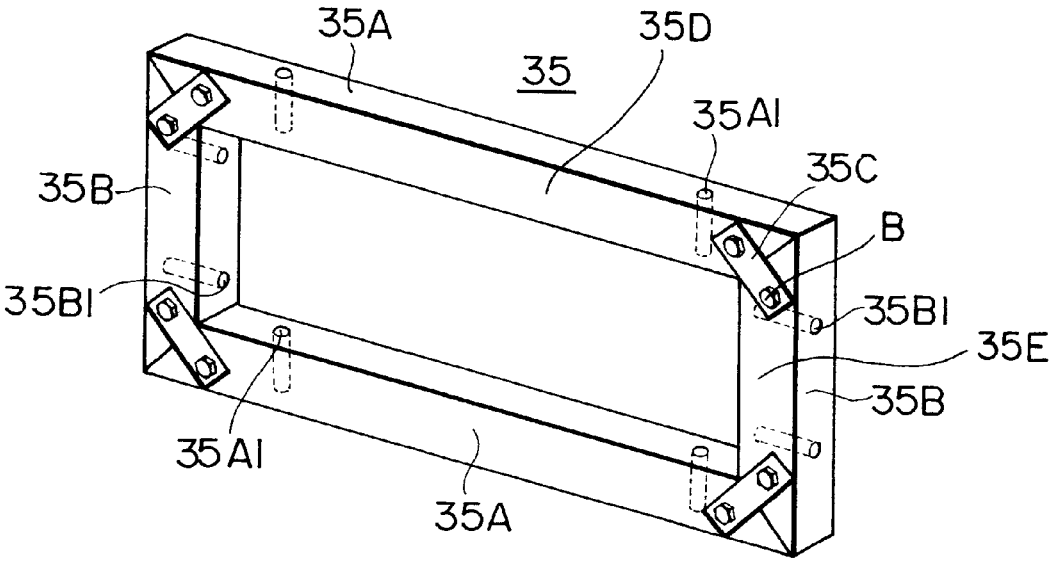
FIG. 40 is a perspective view of another embodiment of the I-shaped block according to the present invention.

In the embodiment of the I-shaped block 35 shown in FIG. 40, the connecting means comprises a plurality of generally rectangular-shaped connecting members or plates 35C provided with a pair of connecting holes. At each right angle corner of the I-shaped block 35, one of the connecting plates 35C is connected to a front surface 35D of the upper or lower members 35A and to a front surface 35E of one of the vertical members 35B by threaded bolts B. The threaded bolts B extend through the connecting holes of the connecting plate 35C and into connecting holes formed on the front surfaces 35D, 35E of the upper or lower members 35A and the vertical member 35B. The I-shaped block 35 is provided with connecting holes 35A1, 35B1 for connection to other modular units as described above for the I-shaped block 3 of FIG. 1.

Figure 41:
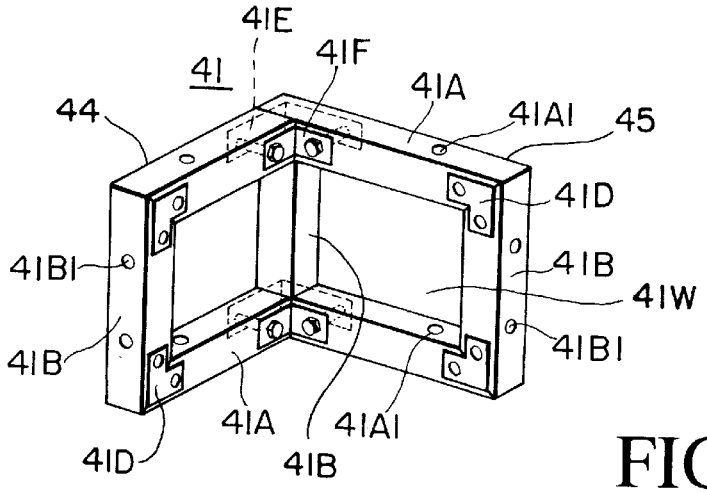
FIG. 41 is a perspective view of another embodiment of the L-shaped block according to the present invention.

FIG. 41 shows another embodiment of the L-shaped block according to the present invention. In this embodiment, the L-shaped block 41 is comprised of two separate structural assemblies 44, 45 which are integrally connected together at right angles to define the open block structure described above with reference to the embodiment of FIG. 2. The structural assembly 44 comprises a pair of parallel, spaced-apart upper and lower members 41A and a transverse or vertical member 41B connecting the upper and lower members in spaced-apart relation. The vertical member 41B is connected to an end of each of the upper and lower members 41A by connecting members 41D having the same structure as the connecting members 31C as described above for the connection of each vertical member 31B to the upper and lower members 31A in the embodiment of the I-shaped block shown in FIG. 35. The structural assembly 45 comprises a pair of parallel, spaced-apart upper and lower members 41A and a pair of transverse or vertical members 41B connecting the upper and lower members in spaced-apart relation, defining an open structure with an opening 41W. One of the vertical members 41B is connected to an end of each of the upper and lower members 41A by connecting members 41D as described above. The L-shaped block 41 is provided with connecting holes 41A1, 41B1 for connection to other modular units as described above for the L-shaped block 4 of FIG. 2.

The structural assembly 44 is integrally connected to the structural assembly 45 by first and second connecting members 41E, 41F having the same structure as the plurality of first and second connecting members 32C, 32D described above for the embodiment of the I-shaped block shown in FIG. 36. One of the first connecting members 41E and one of the second connecting members 41F are connected to each other and to rear and front surfaces of the upper frame members 41A of the structural assemblies 44, 45 by threaded bolts B. Another of the first connecting members 41E and another of the second connecting members 41F are connected to each other and to rear and front surfaces of the lower frame members 41A by threaded bolts B.

Figure 42:
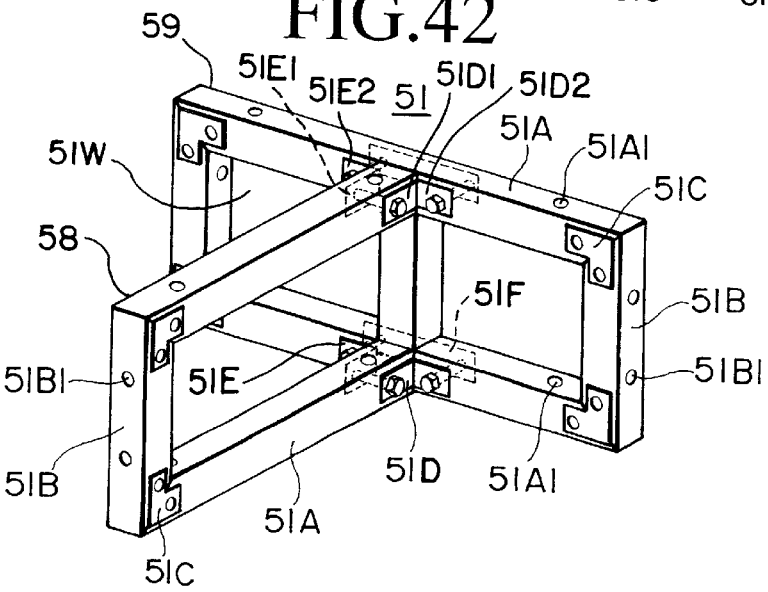
FIG. 42 is a perspective view of another embodiment of the T-shaped block according to the present invention.

FIG. 42 shows another embodiment of the T-shaped block according to the present invention. In this embodiment, the T-shaped block 51 is comprised of two separate structural assemblies 58, 59 which are integrally connected together at right angles to define the open block structure described above with reference to the embodiment of FIG. 3.

The structural assembly 58 comprises a pair of parallel, spaced-apart upper and lower members 51A and a transverse or vertical member 51B connecting the upper and lower members in spaced-apart relation. The vertical member 51B is connected to an end of each of the upper and lower members 51A by connecting members 51C having the same structure as the connecting member 31C as described above for the connection of each vertical member 31B to the upper and lower members 31A in the embodiment of the I-shaped block shown in FIG. 35. The structural assembly 59 comprises a pair of parallel, spaced-apart upper and lower members 51A, and a plurality of transverse or vertical members 51B connecting the upper and lower members in spaced-apart relation. In this embodiment, the structural assembly 59 comprises three vertical members 51B, two of the vertical members forming part of the periphery of the structural assembly 59 and one vertical member being connected to central portions of the upper and lower members 51A to define an open structure having openings 51W. The vertical members 51B defining the periphery of the structural assembly 59 are each connected to an end of each of the upper and lower members 51A by connecting members 51D in the manner described above. The T-shaped block 51 is provided with connecting holes 51A1, 51B1 for connection to other modular units as described above for the T-shaped block 5 of FIG. 3.

The structural assembly 58 is integrally connected to a central portion of the structural assembly 59 at right angles thereof by connecting means to define the open T-shaped block structure. The connecting means comprises a plurality of first, second and third connecting members 51D, 51E and 51F. Each of the first and second connecting members 51D and 51E have mutually perpendicular leg portions 51D1, 51D2 and 51E1, 51E2, respectively, and comprise the same structure as the connecting members 32D described above for the embodiment of the I-shaped block shown in FIG. 36. The first and second connecting members are secured to two upper and two lower right angle corners formed by the abutting surfaces of the upper and lower frames of the structural assemblies 58, 59 as a result of the right angle connection between the first and second structural assemblies 58, 59. The third connecting members 51F comprise a pair of generally rectangular connecting plates each connected to a rear surface of one of the upper and lower frames 51A of the structural assembly 59.

More specifically, at one of the upper right angle corners of the T-shape block 51, the leg portion 51D1 of one of the first connecting members 51D is connected to a front surface of the upper member 51A of the first structural assembly 58, and the leg portion 51D2 of the first connecting member 51D is connected to a front surface of the upper member 51A of the second structural assembly 59. At the other upper right angle corner of the T-shaped block 51, the leg portion 51E1 of one of the second connecting members 51E is connected to a rear surface of the upper member 51A of the first structural assembly 58, and the leg portion 51E2 of the second connecting member 51E is connected to the front surface of the upper member 51A of the second structural assembly 59. The first and second connecting members 51D, 51E are connected to each other by a threaded bolt B which extends through a hole formed in each of the leg portions 51D1 and 51E1, respectively, and a through-hole formed in the upper member 51A of the first structural assembly which is secured by threaded nut N.

The leg portion 51D2 is connected to the third connecting member 51F by a threaded bolt which extends through a hole formed in the leg portion 51D2, a first through-hole formed on the upper member 51A of the second structural assembly 59 and a first hole formed on the third connecting member 51F and which is secured by a threaded nut. Likewise, the leg portion 51E2 is connected to the third connecting member 51F by a threaded bolt which extends through a hole formed in the leg portion 51E2, a second through-hole formed on the upper member 51A of the second structural assembly 59 and a second hole formed on the third connecting member 51F and which is secured by a threaded nut.

The connection between the structural assemblies 58 and 59 at the lower right angle corners of the T-shaped block using first, second and third connecting members 51D, 51E, 51F is as described above for the connection at the upper right angle corners.

Figure 43:
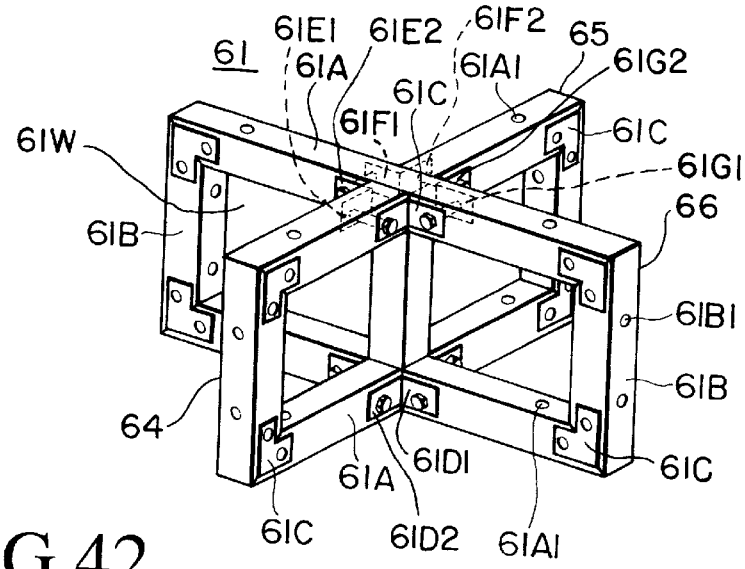
FIG. 43 is a perspective view of another embodiment of the X-shaped block according to the present invention.

FIG. 43 shows another embodiment of the X-shaped block according to the present invention. In this embodiment, the X-shaped block 61 is comprised of three separate structural assemblies 64, 65 and 66 which are integrally connected together at right angles to define the open block structure described above with reference to the embodiment of FIG. 4.

The structural assemblies 64 and 65 are identical to each other and each comprises a pair of parallel, spaced-apart upper and lower members 61A and a transverse or vertical member 61B connecting the upper and lower members in spaced-apart relation. The vertical member 61B is connected to an end of each of the upper and lower members 61A by connecting members 61C having the same structure as the connecting member 31C and in the same manner as described above for the connection of each vertical member 31B to the upper and lower members 31A in the embodiment of the I-shaped block shown in FIG. 35. The structural assembly 66 comprises a pair of parallel, spaced-apart upper and lower members 61A, and a plurality of transverse or vertical members 61B connecting the upper and lower members in spaced-apart relation. In this embodiment, the structural assembly 66 comprises three vertical members 61B, two of the vertical members forming part of the periphery of the structural assembly 66 and one vertical member being connected to central portions of the upper and lower members 61A to define an open structure having openings 61W. The vertical members 61B forming part of the periphery of the structural assembly 66 are each connected to an end of the upper and lower members 61A by connecting members 61D in the manner described above with respect to the connecting member 31C in the embodiment of FIG. 35. The X-shaped block 61 is provided with connecting holes 61A1, 61B1 for connection to other modular units as described above for the X-shaped block 6 of FIG. 4.

The structural assemblies 64 and 65 are integrally connected to central portions of the structural assembly 66 at right angles thereto by connecting means to define the open X-shaped block structure. The connecting means comprises two sets of first, second, third and fourth connecting members 61D, 61E, 61F and 61G. The connecting members 61D, 61E, 61F and 61G have mutually perpendicular leg portions 61D1,61D2, 61E1,61E2, 61F1,61F2 and 61G1,61G2, respectively, and have the same structure as the connecting members 32D described above for the embodiment of the I-shaped block shown in FIG. 36. The connecting members 61D, 61E, 61F and 61G are secured to first, second, third and fourth upper and lower right angle corners, respectively, formed by the abutting surfaces of the upper and lower frames of the structural assemblies 64, 65 and 66 as a result of the right angle connection between the first, second and third structural assemblies 64, 65 and 66. The connection of the first set of connecting members 61D, 61E, 61F and 61G at the upper right angle corners is identical to the connection of the second set of connecting members 61D, 61E, 61F and 61G at the lower right angle corners. Accordingly, only the connection of the first set of connecting members will be described in detail.

The leg portion 61D1 of the connecting member 61D is connected to a front surface of the upper member 61A of the third structural assembly 66, and the leg portion 61D2 of the connecting member 61D is connected to a front surface of the upper member 61A of the first structural assembly 64. The leg portion 61E1 of the connecting member 61E is connected to a rear surface of the upper member 61A of the first structural member 64, and the leg portion 61E2 of the connecting member 61E is connected to the front surface of the upper member 61A of the third structural assembly 66. The leg portion 61F1 of the connecting member 61F is connected to a rear surface of the upper member 61A of the third structural assembly 66, and the leg portion 61F2 of the connecting member 61F is connected to a rear surface of the upper member 61A of the second structural assembly 65. The leg portion 61G1 of the connecting member 61G is connected to a rear surface of the upper member 61A of the third structural assembly 66, and the leg portion 61G2 of the connecting member 61G is connected to a front surface of the upper member 61A of the second structural assembly 65.

The first and fourth connecting members 61D and 61G are connected to each other by a threaded bolt B which extends through a hole formed in each of the leg portions 61D1 and 61G1, respectively, and a through-hole formed in the upper member 61A of the third structural assembly 66. The first and second connecting members 61D and 61E are connected to each other by a threaded bolt B which extends through a hole formed in each of the leg portions 61D2 and 61E1, respectively, and a through-hole formed in the upper member 61A of the first structural assembly 64. The second and the third connecting members 61E and 61F are connected to each other by a threaded bolt a which extends through a hole formed in each of the leg portions 61E2 and 61F1, respectively, and a through-hole formed in the upper member 61A of the third structural assembly 66. The third and fourth connecting members 61F and 61G are connected to each other by a threaded bolt B which extends through a hole formed in each of the leg portions 61F2 and 61G2, respectively, and a through-hole formed in the upper member 61A of the second structural assembly 65.

Preferably, the connecting means described above for the embodiments of the I-shaped, L-shaped, T-shaped and X-shaped blocks shown in FIGS. 35–43 are formed of a suitable rigid structural material including metals such as iron, steel, aluminum or the like.

Figure 5:
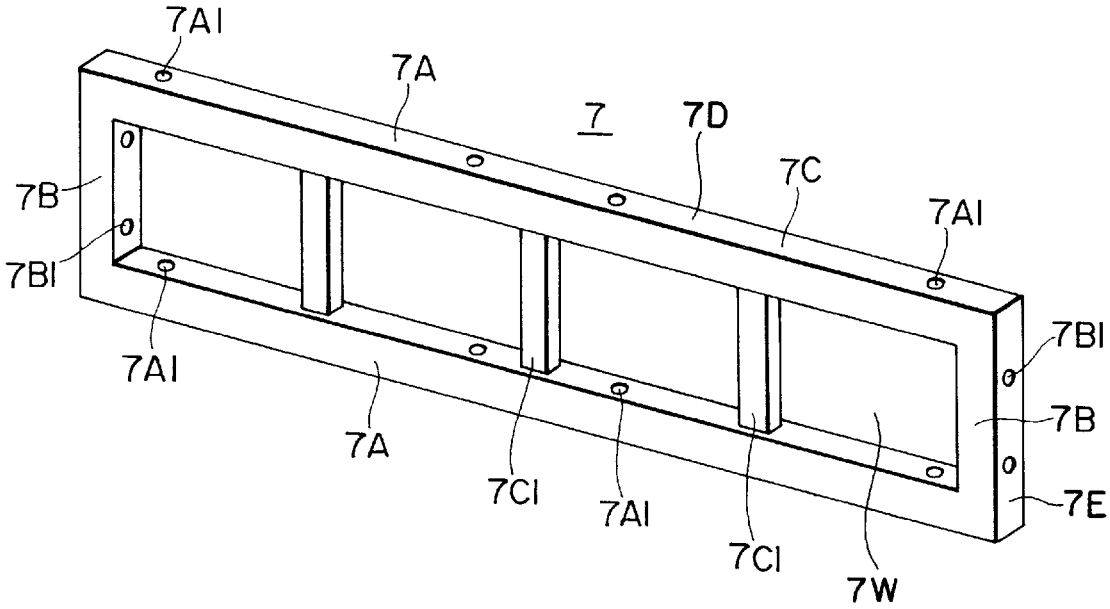
FIG. 5 is a perspective view of a block structure utilized in a modular structure according to the present invention.

A fifth modular unit 7 according to the present invention will now be described with reference to FIGS. 5–7. As shown in FIG. 5, the fifth modular unit 7 is a generally rectangular-shaped open block structure 7C which, as further described below, is utilized, for example, as a beam or a crossbeam for the construction of a modular building structure according to the present invention.

The block structure 7C comprises a pair of parallel, spaced-apart upper and lower members 7A and a pair of parallel, spaced-apart transverse or vertical members 7B connecting the upper and lower members in spaced-apart relation. The vertical members 7B are each connected to respective ends of the upper and lower members 7A in perpendicular relation thereto. A plurality of vertical reinforcing members 7C1 are disposed between the upper and lower members 7A at equally spaced intervals to define openings 7W. The reinforcing members 7C1 are connected to lower surfaces of the upper and lower members 7A and have front and rear surfaces which are not flush with front and rear surfaces of the upper and lower members.

A plurality of vertical connecting through-holes 7A1 are formed on upper and lower connecting surfaces 7D of the upper and lower members 7A near the ends and central portions thereof, and a plurality of horizontal connecting through-holes 7B1 are formed on vertical connecting surfaces 7E of the vertical members 7B near the ends thereof for connecting the block structure 7C to other modular units and/or other structural components of the modular structure. Preferably, the length of the connecting surfaces of the block structure 7C is equal to the length of the connecting surfaces of the I-shaped block, the L-shaped block, the T-shaped block and the X-shaped block, respectively. The connecting through-holes of the block structure 7C and the connecting through-holes of the I-shaped block, the L-shaped block, the T-shaped block and the X-shaped block are formed at predetermined positions on the connecting surfaces thereof such that when one of the connecting surfaces of the block structure 7C is superimposed with a connecting surface of any one of the I-shaped block, the L-shaped block, the T-shaped block or the X-shaped block, the connecting through-holes formed on the respective connecting surfaces are automatically aligned to allow passage therethrough of connecting elements for connection of the modular units.

Preferably, the block structure 7C is formed as an integral unit from a single piece of material, such as wood. However, it is understood by those skilled in the art that the upper and lower members 7A and the vertical members 7B may be formed from a single piece of material and that the reinforcing members 7C1 may be connected between the upper and lower members 7A using suitable connectors. Alternatively, the upper member, the lower member, each of the vertical members and the reinforcing members may all be formed from separate pieces of material and connected together using suitable connecting members to form the open, generally-rectangular block structure shown in FIG. 5. For example, any of the connecting members described above for the embodiments of the modular units shown in FIGS. 35–43 are suitable for connecting the separate pieces of materials of the block structure 7C. Similarly, it is understood that materials other than wood, such as the structural materials described above for the I-shaped block, the L-shaped block, the T-shaped block and the X-shaped block, are also suitable for the block structure 7C.

Figure 23:
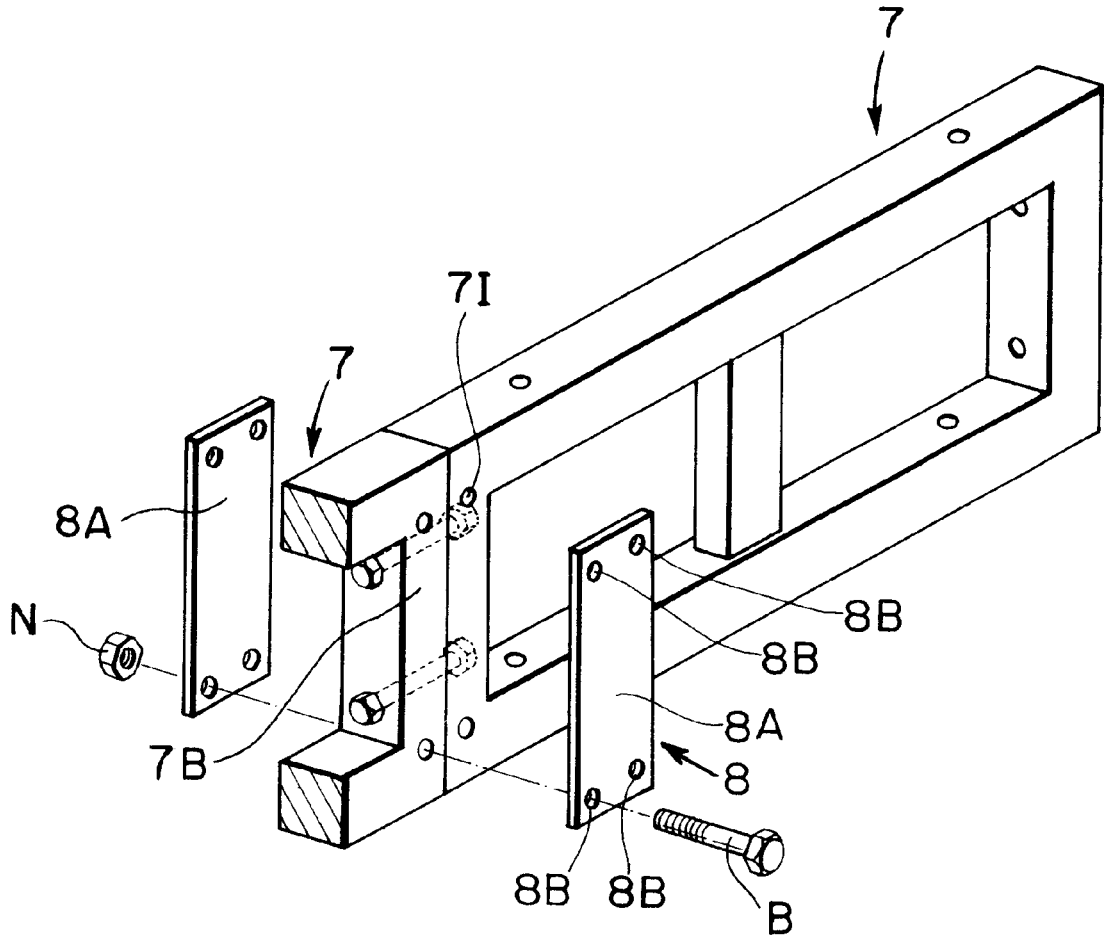
FIG. 23 is partially cutaway, exploded perspective view showing a method of assembling two block structures using a connecting assembly according to the present invention.

Furthermore, although the block structure 7 is shown in FIG. 5 with three vertical reinforcing members 7C1, it is understood that the number of vertical reinforcing members may vary depending on the length of the block structure (i.e., the length of the upper and lower members 7A) selected. For example, the block structure 7 may have one centrally disposed vertical reinforcing member, as shown in FIG. 23.

Figure 6:
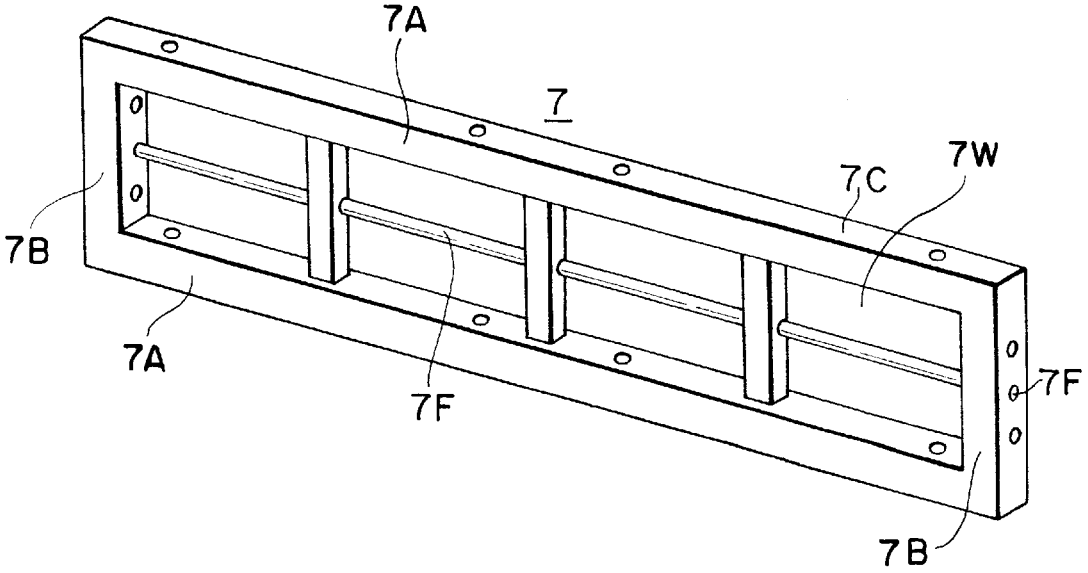
FIG. 6 is a perspective view of another embodiment of a block structure utilized in a modular structure according to the present invention.

A second embodiment of the block structure 7C according to the present invention, as shown in FIG. 6, comprises the structure of the fifth modular unit set forth above for the embodiment of FIG. 5. However, in the embodiment of FIG. 6, a horizontal reinforcing member 7F is disposed in tension within the block structure 7C in parallel relation to the upper and lower members 7A. The horizontal reinforcing member 7F passes through a horizontal through-hole formed in a central portion of each reinforcing member 7C1 and is connected at terminal ends thereof to the vertical members 7B.

Figure 7:
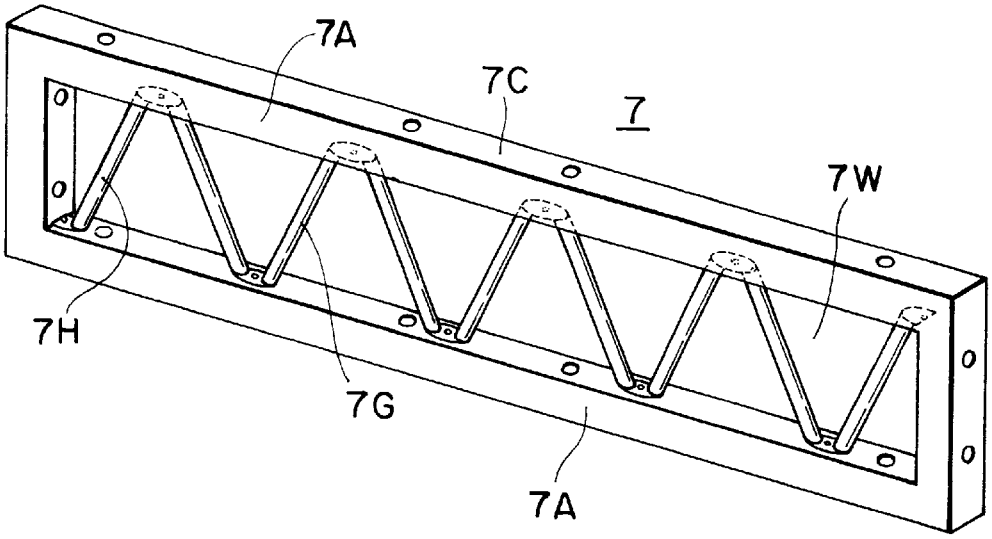
FIG. 7 is a perspective view of another embodiment of a block structure utilized in a modular structure according to the present invention.

FIG. 7 shows a third embodiment of the block structure 7C according to the present invention. In this embodiment, a lattice structure 7G, instead of the vertical reinforcing members 7C1 and the horizontal reinforcing member 7F, is disposed in tension within the block structure 7C for reinforcing the block structure. The lattice structure 7G comprises a plurality of inclined reinforcing members 7H disposed between and connected to the upper and lower members 7A. Each reinforcing member 7H has an end connected to one of the upper and lower members 7A by suitable connecting means, such as by welding or fastening elements.

Figure 8:
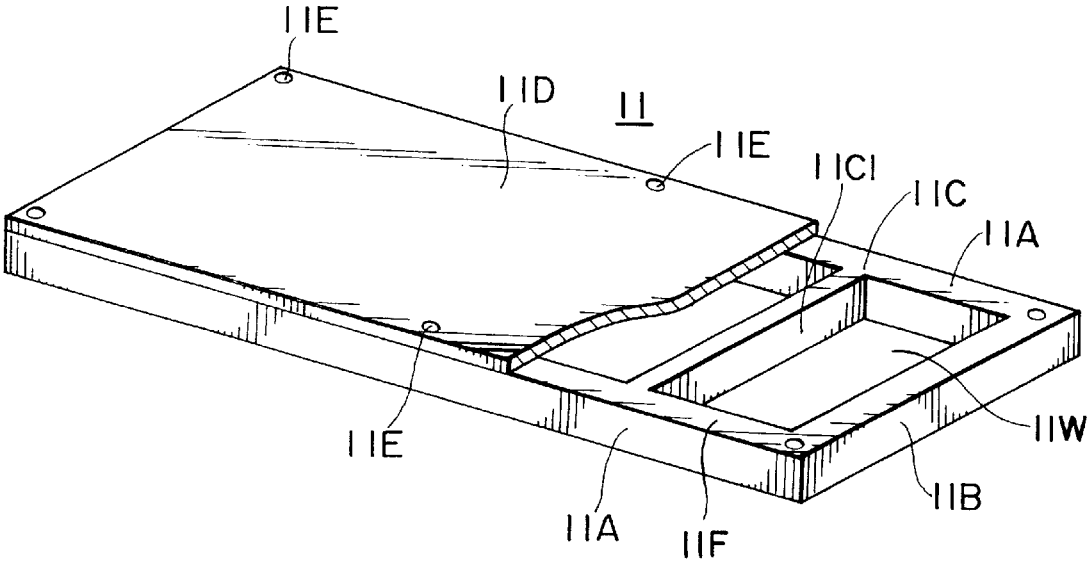
FIG. 8 is a partially cutaway perspective view of a panel assembly utilized in the modular structure according to the present invention.

FIG. 8 shows a panel assembly 11 which is utilized, for example, as a floor panel or a roof panel in the modular structure according to the present invention. The panel assembly 11 comprises a sixth modular unit 11C according to the present invention and a surface plate 11D connected to a surface of the sixth modular unit.

The sixth modular unit 11C is a generally rectangular-shaped open block structure and comprises a pair of parallel, spaced-apart front and rear members 11A and a pair of parallel, spaced-apart transverse or left and right members 11B connecting the front and rear members in spaced-apart relation. The left and right members 11B are each connected to respective ends of the front and rear members 11A in perpendicular relation thereto. A plurality of reinforcing members 11C1 are disposed vertically between and connected to the front and rear members 7A to define openings 11W. The block structure 11C comprises substantially the same structure as the block structure 7C described above for the embodiment shown in FIG. 5. However, in the block structure 11C, the reinforcing members 11C1 have upper and lower surfaces which are flush with upper and lower connecting surfaces 11F of the front and rear members 11A and left and right members 11B. The surface plate 11D comprises, for example, a veneer plate, and is connected to the connecting surface 11F of the block structure 11C using suitable connecting elements via connecting holes 11E formed on the surface plate.

Preferably, as shown in the figures, the upper, lower, vertical, front and rear members of the modular units according to the present invention have the same cross-sectional shape and cross-sectional area, and the connecting surfaces thereof are all planar and have the same length. Accordingly, all of the modular units according to the present invention have a uniform height. In the embodiments shown, the upper, lower, vertical, front and rear members of the modular units are generally square-shaped in cross-section. It is understood, however, that other cross-sectional configurations and surface types are suitable for the upper, lower, vertical, front and rear members and the connecting surfaces so long as the respective connecting surfaces can provide a stable and rigid connecting surface for connection of the blocks to one another and/or to other structural components of a modular structure.

It will be appreciated from the foregoing construction that the I-shaped block, the L-shaped block, the T-shaped block, the X-shaped block, the block structure 7 and the block structure 11C define a set of modular units of uniform construction which facilitates assembly thereof by amateur builders during construction of modular structures. For example, since the upper, lower, vertical, front and rear members of the modular units according to the present invention have the same cross-sectional shape and cross-sectional area, the connecting surfaces thereof are all planar and have the same length, and the connecting through-holes are uniformly formed on the connecting surfaces of all of the modular units (i.e., formed at the same locations), when respective connecting surfaces of modular units to be connected are superimposed, the respective connecting through-holes are automatically aligned to permit a connecting element, such as a threaded bolt, to be passed therethrough for connecting the modular units. Thus the amount of time required to construct a modular structure utilizing the modular units of the present invention is substantially reduced as compared to conventional modular structure construction methods.

A roof truss block assembly 9 which is constructed with modular units according to the present invention will be described below with reference to FIGS. 10 and 17–19. As further described below, a roof truss block assembly 9 is utilized in a gable roof system for a modular building structure according to the present invention. For example, as shown in FIG. 10, the roof truss block assembly 9 will be described with a particular application to a gable roof having inclined roof sections that intersect at a roof summit.

Figure 10:
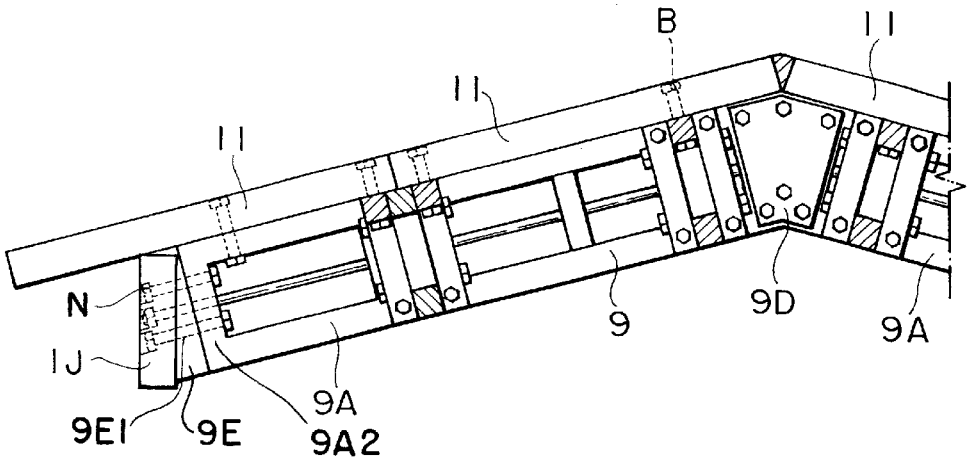
FIG. 10 is a partially cutaway enlarged sectional view taken along line 10—10 of FIG. 9.
Figure 17:
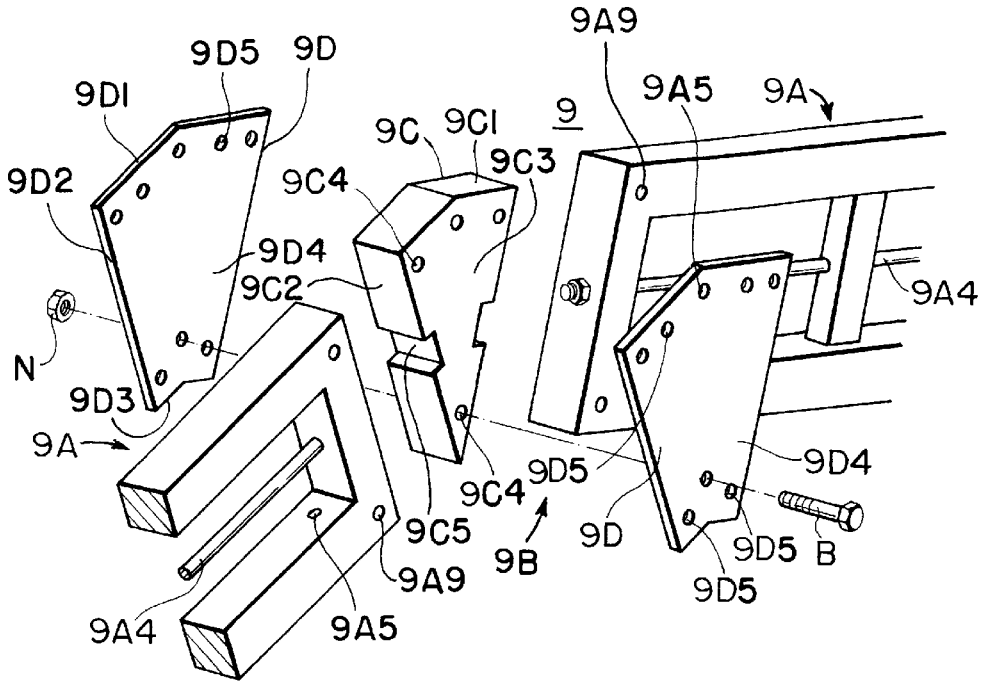
FIG. 17 is a partially cutaway exploded view of an embodiment of a roof truss block assembly for a gable roof system utilized in the modular structure shown in FIG. 9.

As shown in FIGS. 10 and 17, the roof truss block assembly 9 comprises a pair of truss units 9A, a connecting assembly 9B for connecting the truss units to one another, and connecting members 9E each for connection between an end of one of the truss units and a structural component of a modular building structure.

Figure 18:
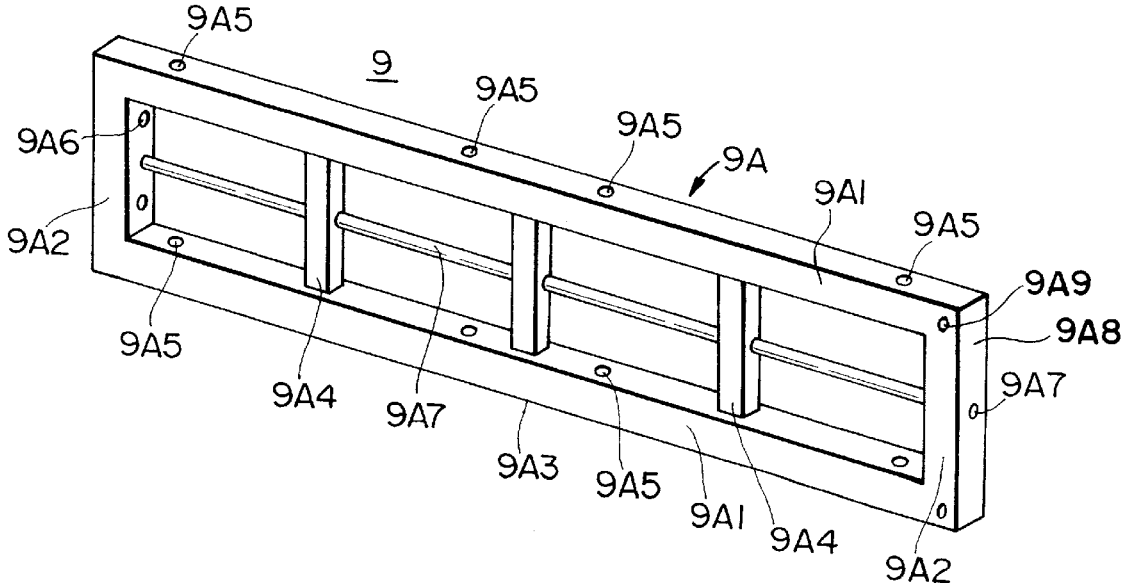
FIG. 18 is a perspective view of a truss unit of the roof truss block assembly shown in FIG. 17.

The truss units 9A are generally identical in their construction, and the construction of only one of these truss units will be described and illustrated in detail. As shown in FIG. 18, the truss unit 9A is a generally rectangular-shaped open block structure 9A3 which comprises upper and lower members 9A1, vertical members 9A2, a plurality of vertical reinforcing members 9A4, a plurality vertical connecting through-holes 9A5, a plurality of horizontal connecting through-holes 9A6, and a horizontal reinforcing member 9A7. The block structure 9A3 has substantially the same structure as the block structure 7 described above for the embodiment of FIG. 6, except that connecting through-holes are not formed in a connecting surface 9A8 of one of the vertical members 9A2 for connecting the block structure 9A3 to other modular units. A threaded end of the reinforcing member 9A7 passes through a horizontal through-hole formed on the vertical member 9A2 and extends from the connecting surface 9A8. A threaded nut N is threadedly engaged with the threaded end of the horizontal reinforcing member 9A7 for securing the horizontal reinforcing member to the block structure 9A3. Connecting through-holes 9A9 are formed on a front surface of the vertical member 9A2 for receiving connecting elements, such as threaded bolts B, for connecting the connecting members 9D to the block structure 9A3 (see FIG. 17).

Figure 19:
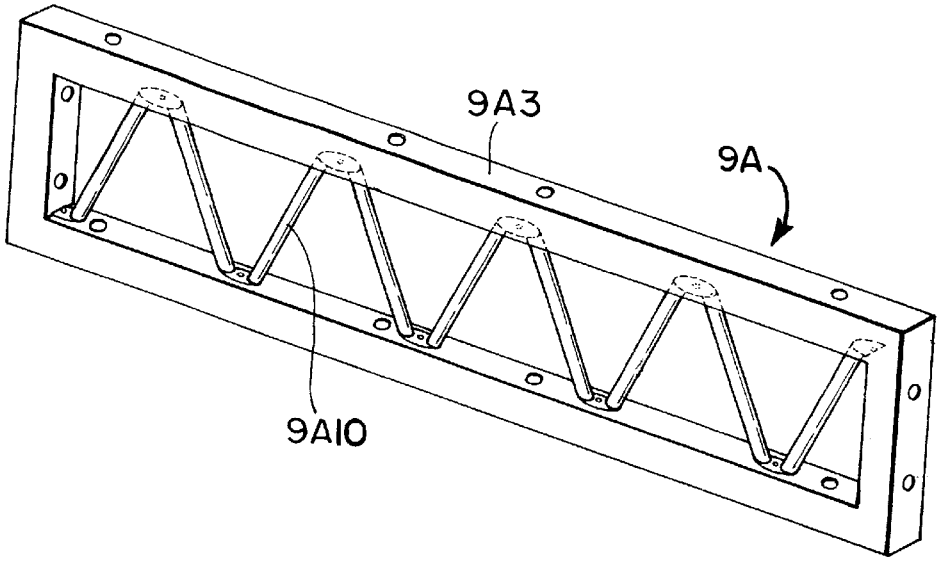
FIG. 19 is a perspective view of another embodiment of a truss unit of the roof truss block assembly shown in FIG. 17.

FIG. 19 shows another embodiment of the truss units 9A utilized in the roof truss block assembly 9 for a modular building structure according to the present invention. The truss unit 9A shown in FIG. 19 is substantially identical in construction to the truss unit 9A shown in FIG. 18 except that a lattice structure 9A10, instead of the vertical reinforcing members 9A4 and the horizontal reinforcing member 9A7, is disposed in tension within the block structure 9A3 for reinforcing the block structure. The construction of the lattice structure 9A10 is generally identical to the construction of the lattice structure 7G described above for the embodiment of the block structure 7 shown in FIG. 7.

It is understood by those ordinarily skilled in the art that the various variations for the block structures 7 described above for the embodiments shown in FIGS. 5–7 are also applicable for the block structures 9A3.

Referring again to FIGS. 10 and 17, the connecting assembly 9B comprises a connecting piece 9C for connection between the connecting surfaces 9A8 of the truss units 9A, a pair of connecting plates 9D for connection to the connecting piece 9C and the truss units 9A by means of connecting elements, such as threaded bolts B and threaded nuts I, and a pair of connecting pieces 9E for connection between an end of one of the truss units 9A and a structural component of a modular building structure.

The connecting piece 9C comprises a block which is generally V-shaped in front view and has inclined upper surfaces 9C1, inclined side surfaces 9C2, generally flat front and rear surfaces 9C3, and a plurality of connecting through-holes 9C4 extending from the front surface to the rear surface. The inclined upper surfaces 9C1 are disposed at an angle which corresponds to a selected angle of the inclined roof sections for the gable roof system. A notch or slot 9C5 is formed on each of the inclined side surfaces 9C2 which receives the threaded end of the horizontal reinforcing member 9A4 and threaded nut N extending from the connecting surface 9A8 of one of the truss units 9A when the truss units are connected to one another by the connecting assembly 9B. Preferably, the vertical extension and the width (i.e., thickness of the connecting piece 9C) of each of the inclined side surfaces 9C2 are generally identical to the height and thickness of one of the vertical members 9A2 of a respective truss unit 9. By this construction, each of the inclined side surfaces 9C2 of the connecting piece 9C engages the connecting surface 9A8 of one of the truss units 9 in surface-to-surface contact when the truss units are connected by connecting assembly 9B.

Preferably, the connecting piece 9C, is formed of the same structural material as the modular units described above according to the present invention. For example, suitable structural materials for the connecting piece 9C include wood, iron, steel, aluminum or the like, or any of a number of known plastic materials such as polystyrene, several of the vinyl chlorides, several of the polyacrylates and polymethacylates.

The connecting plates 9D are generally identical in construction and are generally trapezoidal-shaped in front view. Each connecting plate 9D comprises inclined upper edges 9D1, inclined side edges 9D2, inclined lower edges 9D3, generally flat front and rear surfaces 9D4, and a plurality of connecting through-holes 9D5 extending from the front surface to the rear surface. The inclined upper edges 9D1 and the inclined lower edges 9D3 are disposed at an angle which corresponds to the angle of the inclined upper surfaces 9C1 of the connecting piece 9C and to the selected angle for the inclined roof sections for the gable roof system. Preferably, the connecting plates 9D are formed of iron. However, it is understood that other structural metal materials, such as steel or aluminum, are suitable for the connecting plates 9D.

As shown in FIG. 10, each of the connecting members 9E is connected between an end of one of the truss units 9 and a structural component 1J of a modular building structure, such as, for example, a crossbeam of a roof floor. Since the connecting members 9E are identical in construction, only one is described and illustrated in detail.

The connecting member 9E has a generally inverted V-shape in front view and comprises two inclined side surfaces and a lower surface. A plurality of connecting through-holes 9E1 extend from one of the inclined side surfaces to the other inclined side surface. Each of the inclined side surfaces is connected to a connecting surface of one of the vertical members 9A2 of the truss unit 9A and a connecting surface of the structural component 1J by connecting elements, such as threaded bolts B and threaded nuts N. Preferably, the connecting members 9E are formed of the same structural material as the connecting piece 9C and the modular units described above according to the present invention. For example, suitable structural materials for the connecting members 9E include wood, iron, steel, aluminum or the like, or any of a number of known plastic materials such as polystyrene, several of the vinyl chlorides, several of the polyacrylates and polymethacylates.

Figure 20:
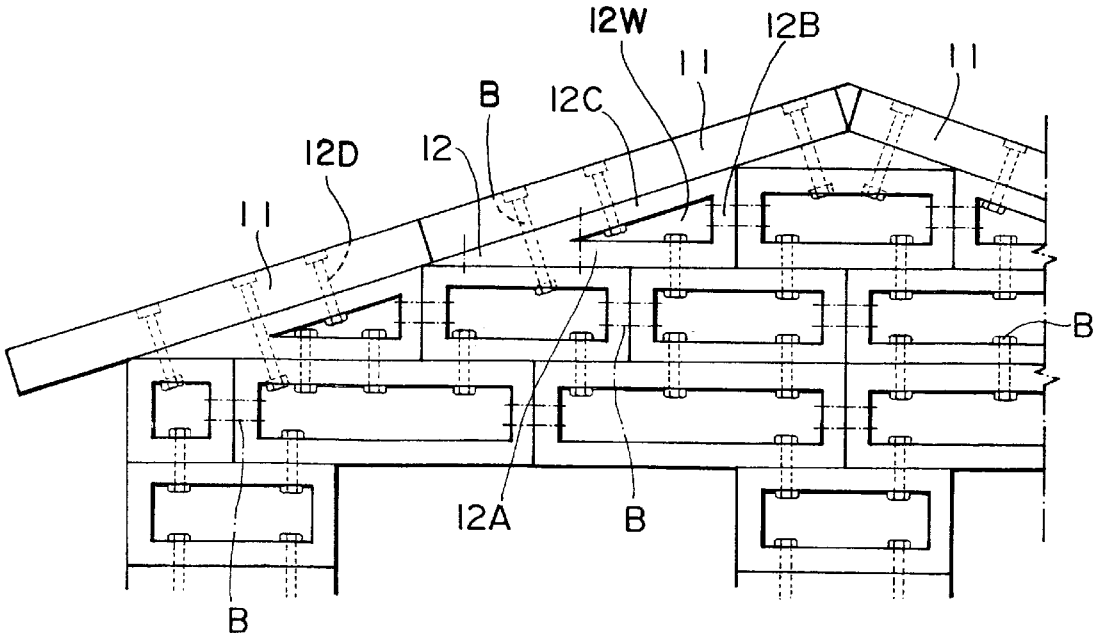
FIG. 20 is a partially cutaway front view showing a method of assembling a triangle block for a gable roof system utilized in the modular structure according to the present invention.

FIG. 20 shows a seventh modular unit 12 according to the present invention which is utilized in the gable roof system for a modular building structure according to the present invention. The modular unit 12 is a generally triangular-shaped open block structure comprising a lower or base member 12A having two ends, a vertical member 12B having one end connected to one end of the base member 12A, and a diagonal member 12C having opposite ends each connected to the other end of one of the base member 12 and the vertical member 12B, thereby defining an opening 12W. A plurality of connecting through-holes 12D are formed on the base member 12A and the diagonal member 12C for receiving connecting elements, such as threaded bolts B, to connect the modular unit 12 to other modular units and/or structural components of the modular structure according to the present invention. In this embodiment, the modular unit 12 is generally in the form of a right triangle.

A roof truss block assembly 10 according to another embodiment which is constructed with modular units of the present invention will be described below with reference to FIGS. 25 and 32–34. As further described below, the roof truss block assembly 10 is utilized in a snow duct roof system for a modular building structure according to the present invention. For example, as shown in FIG. 25, the roof truss block assembly 10 will be described with a particular application to a snow duct roof having inclined roof sections that intersect at a predetermined angle to define the lowest point of the roof.

Figure 25:
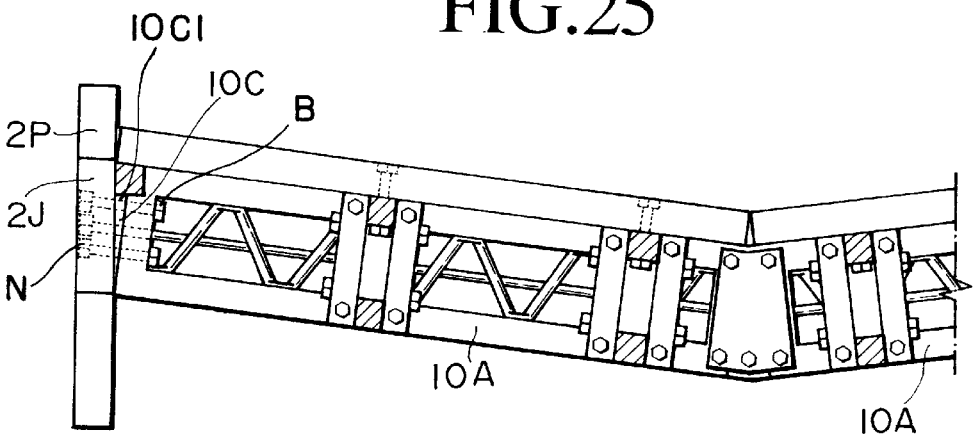
FIG. 25 is a partially cutaway enlarged sectional view taken along line 25—25 of FIG. 24.
Figure 32:
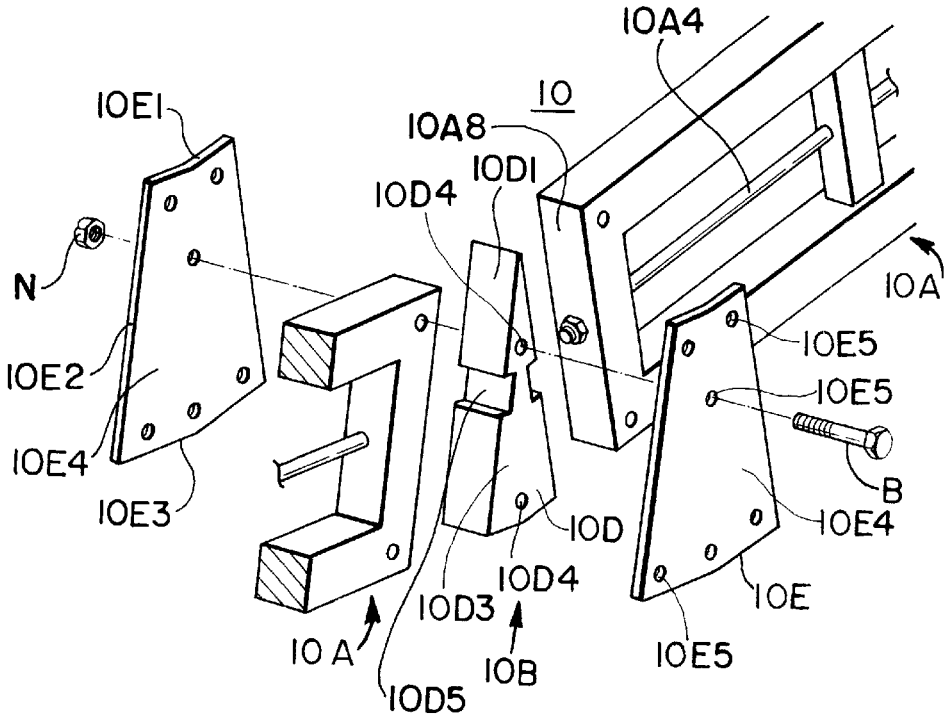
FIG. 32 is a partially cutaway perspective view of a roof truss block assembly for the snow duct roof system of FIG. 31.
Figure 33:
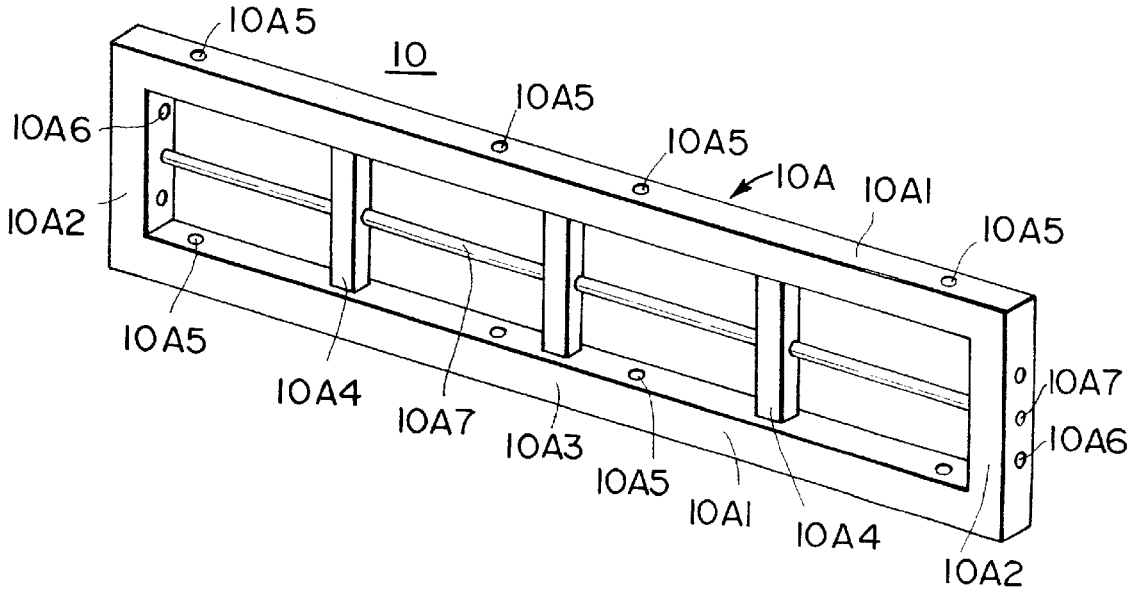
FIG. 33 is a perspective view of a truss unit for the roof truss block assembly of FIG. 32.
Figure 34:
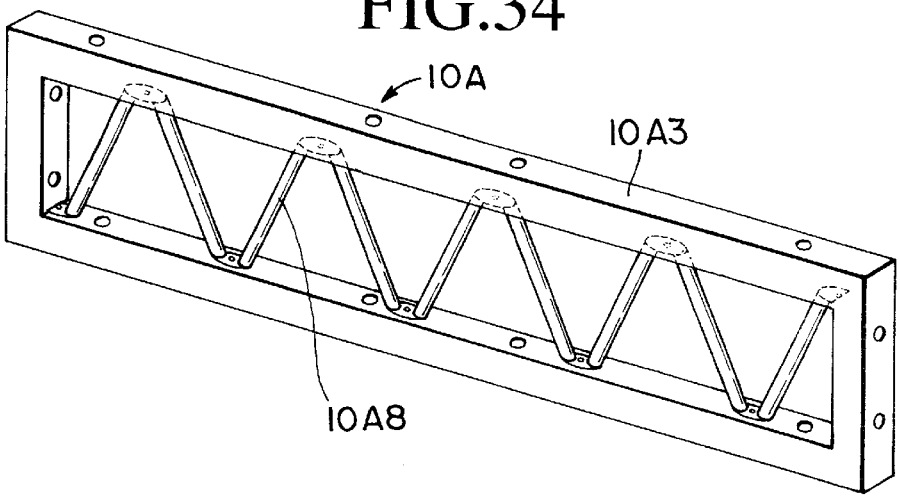
FIG. 34 is a perspective view of another embodiment of a truss unit for the roof truss block assembly of FIG. 32.

As shown in FIGS. 25 and 32, the roof truss block assembly 10 comprises a pair of truss units 10A, a connecting assembly 10B for connecting the truss units to one another, and connecting members 10C each for connection between an end of one of the truss units and a structural component of a modular building structure. As shown in FIGS. 33 and 34, each of the truss units 10A is a generally rectangular-shaped open block structure 10A3 comprising upper and lower members 10A1, vertical members 10A2, a plurality of vertical reinforcing members 10A4, a plurality of vertical connecting through-holes 10A5, a plurality of horizontal connecting through-holes 10A6, and a horizontal reinforcing member 10A7. In the embodiment of FIG. 34, a lattice structure 10A8, instead of the vertical reinforcing members 10A4 and the horizontal reinforcing member 10A7, is disposed in tension within the block structure 10A for reinforcing the block structure. Since the construction of the truss units 10A shown in FIGS. 33 and 34 is generally identical to the construction of the truss units 9A described above for the embodiment of the roof truss block assembly 9 shown in FIGS. 18 and 19, respectively, a further detailed description is omitted.

Referring again to FIG. 32, the connecting assembly 10B comprises a connecting piece 10D for connection between connecting surfaces 10A8 of the truss units 10A, and a pair of connecting plates 10E for connection to the connecting piece 10D and the truss units 10A by means of connecting elements, such as threaded bolts B and threaded nuts N.

The connecting piece 10D comprises a block which has a generally inverted V-shape in front view and has inclined side surfaces 10D1, inclined lower surfaces 10D2, generally flat front and rear surfaces 10D3, and a plurality of connecting through-holes 10D4 extending from the front surface to the rear surface. The inclined lower surfaces 10D2 are disposed at an angle which corresponds to the preselected angle of the inclined roof sections for snow duct roof system. A notch or slot 10D5 is formed on each of the inclined side surfaces 10D1 which receives the threaded end of the horizontal reinforcing member 10A4 and threaded nut N extending from the connecting surface 10A8 of one of the truss units 10A when the truss units are connected to one another by the connecting assembly 10D. Preferably, the vertical extension and the width (i.e., thickness of the connecting piece 10D) of each of the inclined side surfaces 10D1 are generally identical to the height and thickness of one of the vertical members 10A2 of a respective truss unit 10. By this construction, each of the inclined side surfaces 10D1 of the connecting piece 10D engages the connecting surface 10A8 of one of the truss units 10A in surface-to-surface contact when the truss units are connected by the connecting assembly 10B.

Preferably, the connecting piece 10D is formed of the same structural material as the modular units described above according to the present invention. For example, suitable structural materials for the connecting piece 10D include wood, iron, steel, aluminum or the like, or any of a number of known plastic materials such as polystyrene, several of the vinyl chlorides, several of the polyacrylates and polymethacylates.

The connecting plates 10E are generally identical in construction and generally trapezoidal-shaped in front view.

Each connecting plate 10E comprises inclined upper edges 10E1, inclined side edges 10E2, inclined lower edges 10E3, generally flat front and rear surfaces 10E4, and a plurality of connecting through-holes 10E5 extending from the front surface to the rear surface. The inclined upper edges 10E1 and the inclined lower edges 10E3 are disposed at an angle which corresponds to the predetermined angle of the inclined lower surfaces 10D2 of the connecting piece 10D and to the predetermined angle between the inclined roof sections for the snow duct roof system. Preferably, the connecting plates 10E is formed of iron. However, it is understood that other structural metal materials, such as steel or aluminum, are suitable for the connecting plates 10E.

As shown in FIG. 25, each of the connecting members 10C is connected between an end of one of the truss units 10A and a structural component 2J of a modular building structure, such as, for example, a crossbeam of a roof floor. Since the connecting members 10C are identical in construction, only one is described and illustrated in detail.

The connecting member 10C is generally V-shaped in front view and comprises an upper surface and two inclined side surfaces. A plurality of connecting through-holes 10C1 extend from one of the inclined side surfaces to the other inclined side surface. Each of the inclined side surfaces is connected to a connecting surface of one of the vertical members 10A2 of the truss unit 10A and a connecting surface of the structural component 2J by means of connecting elements, such as threaded bolts B and threaded nuts N. Preferably, the connecting members 10C are formed of the same structural material described above for the connecting piece 10D and the modular units according to the present invention.

Two embodiments of connecting assemblies for connecting the modular units of the present invention to one another will be described below with reference to FIGS. 21–23.

Figure 13:
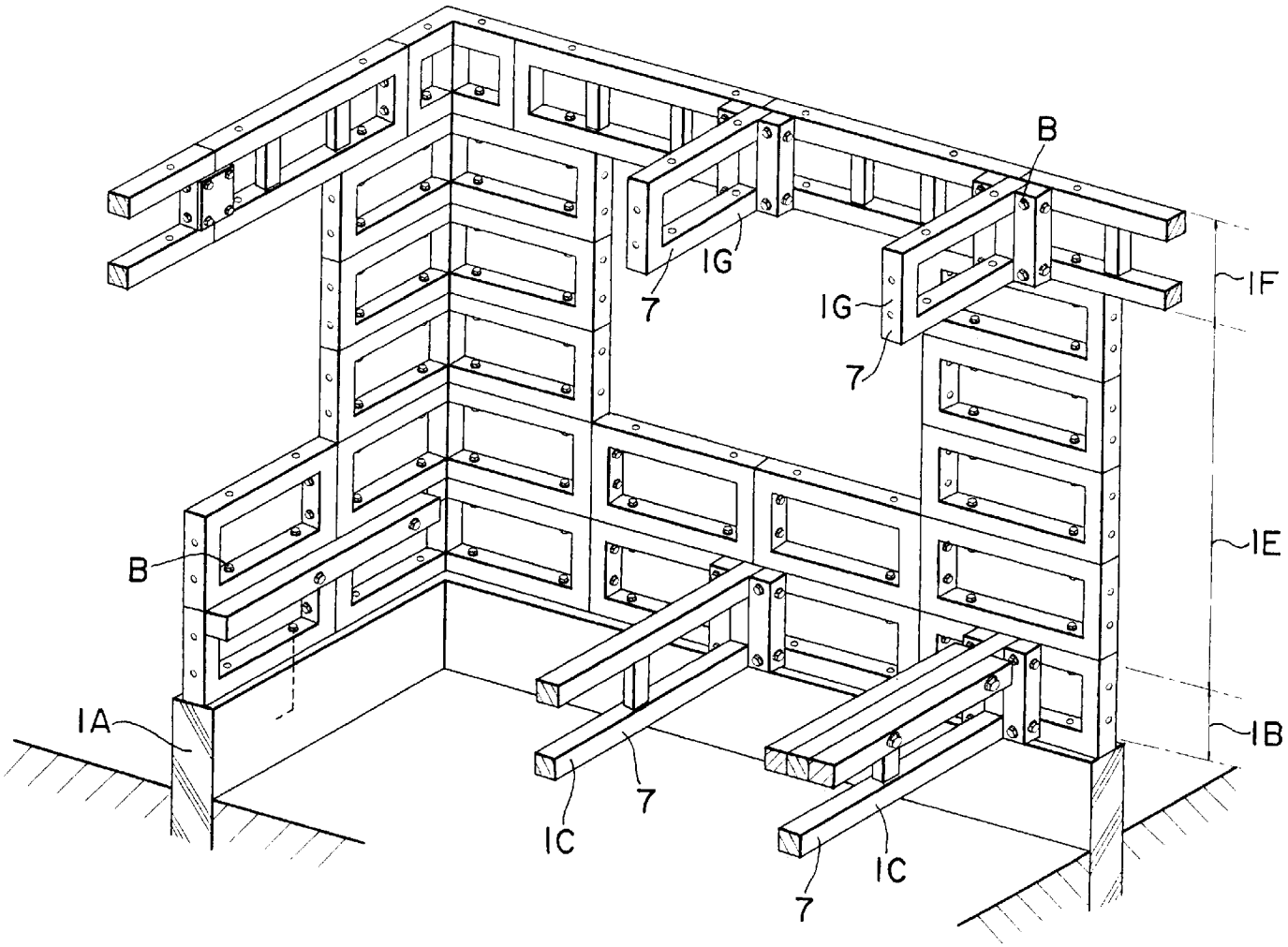
FIG. 13 is a partially cutaway enlarged sectional view showing a method of assembling wall, beam and crossbeam portions for the modular structure of FIG. 9.
Figure 21:
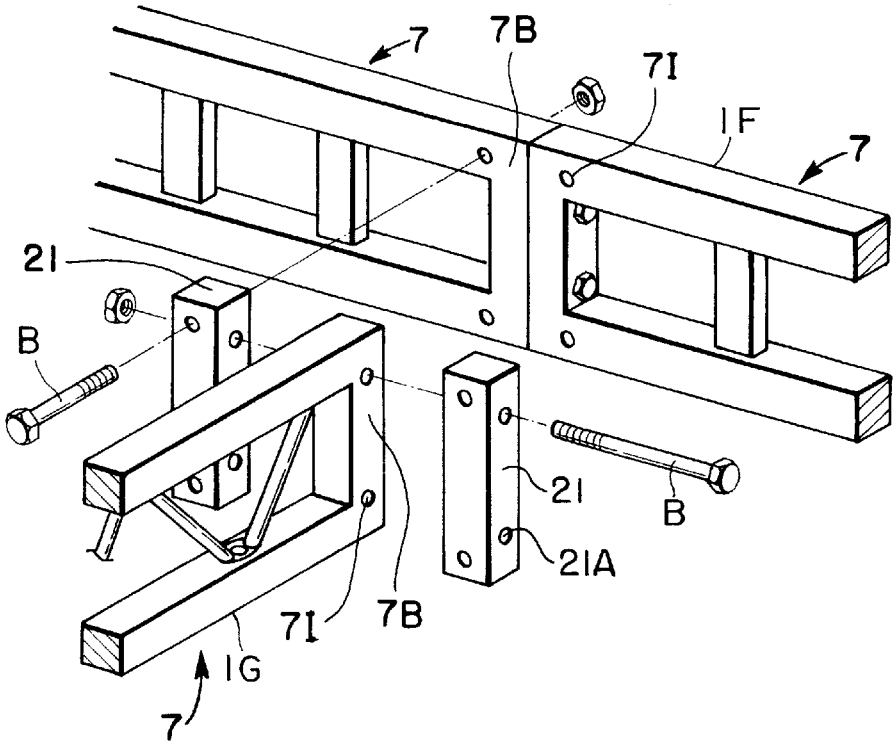
FIG. 21 is a partially cutaway, exploded perspective view showing a method of assembling a beam portion and a crossbeam portion of a first floor.
Figure 22:
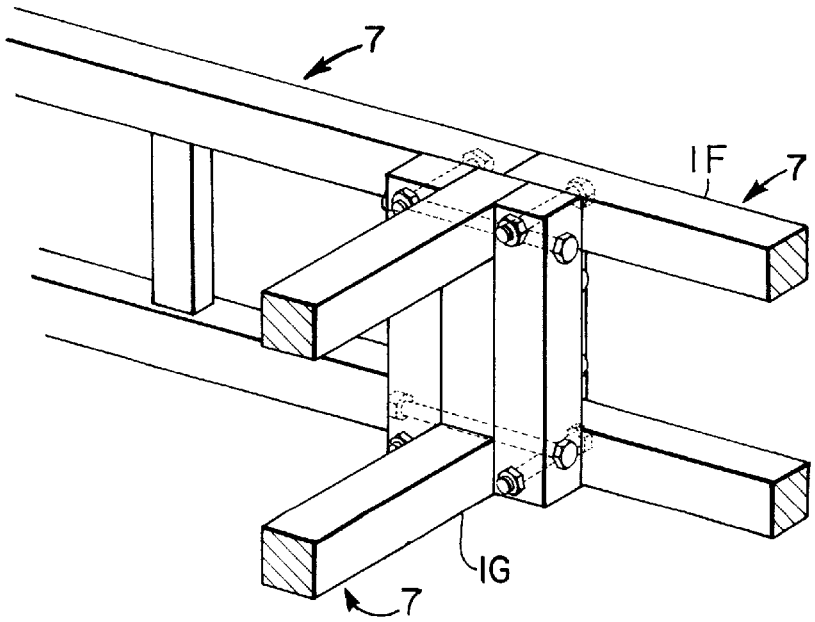
FIG. 22 is a partially cutaway perspective view showing the beam and crossbeam portions of FIG. 21 in an assembled state.

FIGS. 21–22 shows a connecting assembly for connecting a modular unit 7 to a connecting junction of two other modular units 7, in perpendicular relation thereto, which have been connected end-to-end by means of threaded bolts a extending through connecting through-holes 7B1 formed on vertical members 7B. The modular units 7 are generally identical to the modular units described above for the embodiments of FIGS. 5 and 7 except that additional connecting through-holes 7I are formed on the vertical members 7B of each modular unit 7. The connecting assembly comprises a pair of generally rectangular-shaped blocks 21 having a plurality of connecting through-holes 21A and connecting elements, such as threaded bolts B and threaded nuts N, for connecting the modular unit 7 to the other modular units 7 in perpendicular relation thereto as shown in FIG. 22. Preferably, the blocks 21 and the modular units 7 all have the same height so that surfaces of the blocks and the modular units at connecting junctions thereof are flush. When connected as shown in FIG. 22, the block structures 7C connected end-to-end and the block structure 7C connected perpendicular thereto are utilized as a crossbeam 1F and a beam 1G, respectively, for the construction of a modular structure according to the present invention as shown in FIG. 13.

FIG. 23 shows a connecting assembly 8 according to another embodiment of the present invention for connecting two modular units 7 of the present invention in end-to-end relation. The modular units 7, of which only one is shown in full view, has generally the same structure as the modular unit 7 described above for the embodiment of FIG. 5 except that only one reinforcing member 7C1 is provided between the upper and lower members 7A and that additional connecting through-holes 7I are formed on the vertical members 7B. It is understood, however, that the connecting assembly 8 may be used to connect any two of the modular units 7 described above for the embodiments of FIGS. 5–7 in end-to-end relation.

The connecting assembly 8 comprises a pair of connecting plates 8A each having a plurality of connecting through-holes 8B, and a plurality of connecting elements, such as threaded bolts B and nuts N. Each of the connecting plates 8*a* is generally rectangular-shaped and is preferably comprised of, for example, a veneered plate or iron plate.

Connection of the modular units 7 in end-to-end relation using the connecting assembly 8 is accomplished by first bringing the connecting surface 7E (see FIG. 5) of each modular unit into abutment to form a connecting junction so that respective pairs of connecting through-holes 7B1 formed on the connecting surfaces are aligned with one another. The modular units 7 are then connected by inserting a threaded bolt B through each pair of through holes 7B1 and securing the threaded bolt with a threaded nut N. Thereafter, each of the connecting plates 8A is superposed on one of the front and rear surfaces of the modular units 7 at the connecting junction thereof so that the connecting through-holes 8B of each of the connecting plates 8A are aligned with each other and with the connecting through-holes 7I formed on the vertical members 7B of the modular units. The connecting plates 8A are then secured at the connecting junction of the modular units by threaded bolts B and threaded nuts N.

It is understood that connection of the modular units 7 in end-to-end relation can be similarly accomplished by first securing the connecting plates 8A as described above and then inserting the bolts B through the connecting through-holes 7B1 of the modular units and securing the bolts via threaded nuts N. Moreover, it is understood that the connecting plates 8A may be omitted when a determination is made, based on the particular design of the modular building structure employing the modular units 7, that the connecting elements passing through the connecting through-holes 7B1 of the modular units provide sufficient connection for the modular units in end-to-end relation. In this instance, the connecting plates 8A may be employed as reinforcement plates for reinforcement of the connection if necessary.

Methods for constructing modular structures employing the modular units and connection assemblies of the present invention will now be described with a particular application to modular building structures.

FIGS. 9–17 and 20–23 illustrate a method for constructing a modular building structure 1 having a first floor, a second floor and a gable roof system. As shown in FIGS. 9 and 12–14, a foundation 1A preferably comprised of a suitable concrete material is prepared using conventional methods. A first floor of the building structure is then constructed by first disposing I-shaped blocks 3 an L-shaped blocks 4 on the foundation 1A and successively connecting these blocks to each other by means of any of the connecting assemblies described above to form a beam support portion 1B for supporting front, rear, left and right support beams 1C of the building structure. T-shaped blocks 5 and X-shaped blocks 6 are utilized if the particular design of the building structure requires them.

Figure 12:
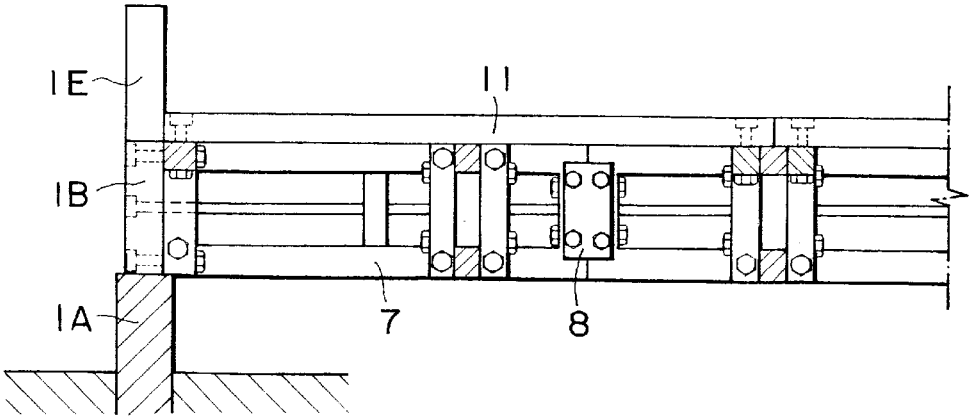
FIG. 12 is a partially cutaway enlarged sectional view taken along line 12—12 of FIG. 9.
Figure 14:
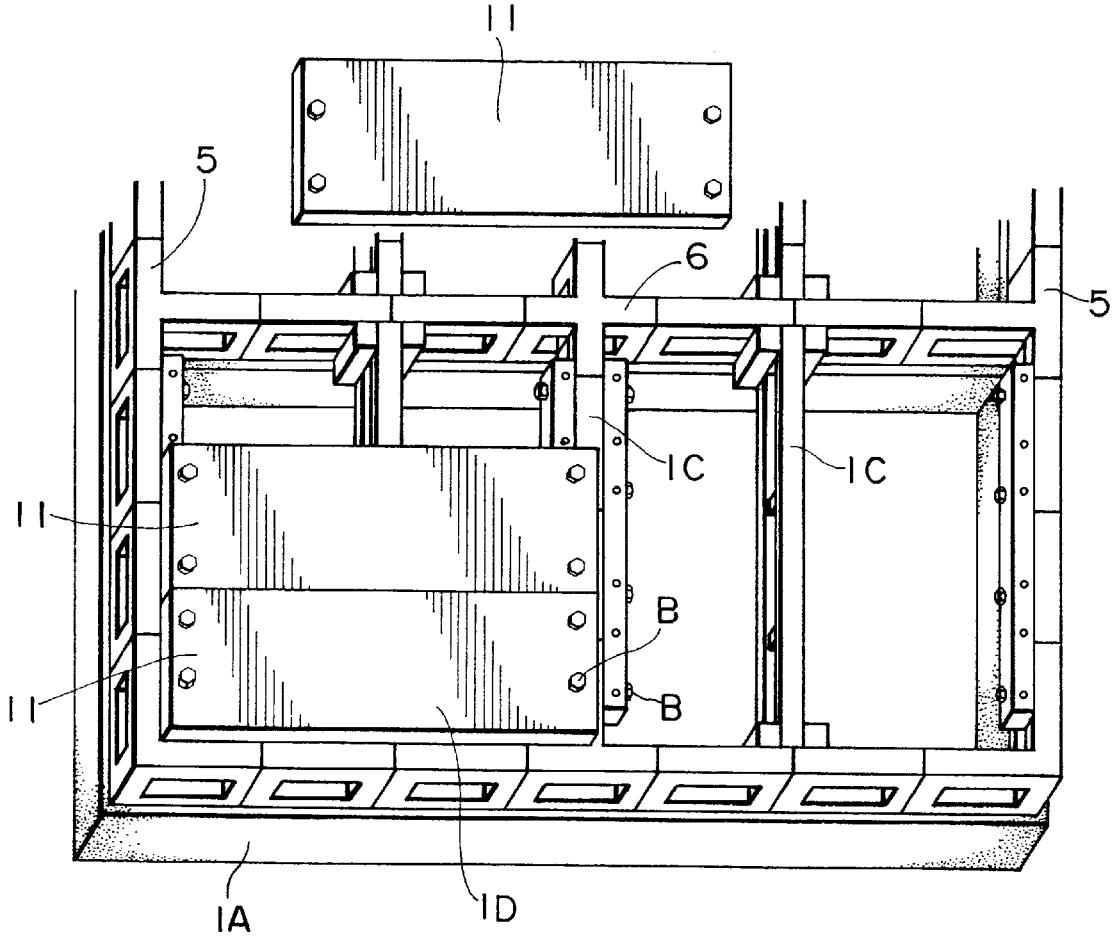
FIG. 14 is a partially cutaway enlarged sectional view showing a method of assembling a floor portion of a first floor for the modular structure of FIG. 9.

Block structures 7 are then connected in tension to inner surfaces of the beam support portion 1B using, for example, the connection assembly described above for the embodiment of FIGS. 21–22 to define the support beams 1C of the first floor. As shown in FIG. 12 and 14, panel assemblies 11 are then connected to upper surfaces of the support beams 1C to form a floor 1D of the first floor. Using the floor 1D as a scaffold, I-shaped blocks 3 and L-shaped blocks 4 are then successively connected to each other and to the beam support portion 1B of the first floor to form a wall face 1E of the first floor (FIGS. 9, 12, 13).

Figure 11:
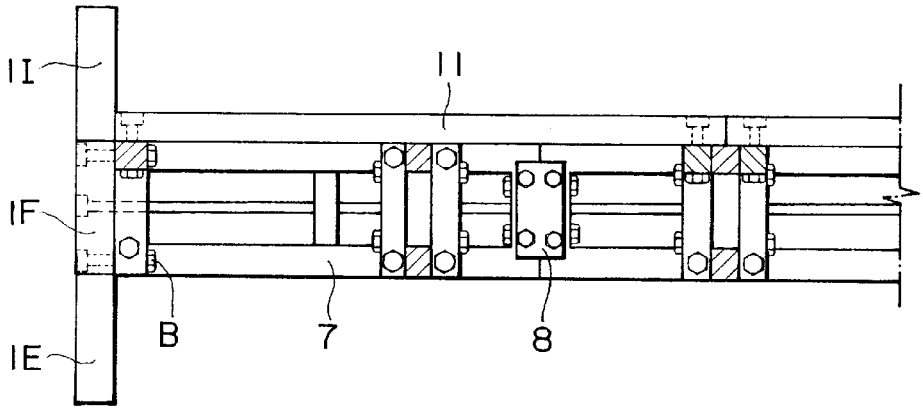
FIG. 11 is a partially cutaway enlarged sectional view taken along line 11—11 of FIG. 9.
Figure 15:
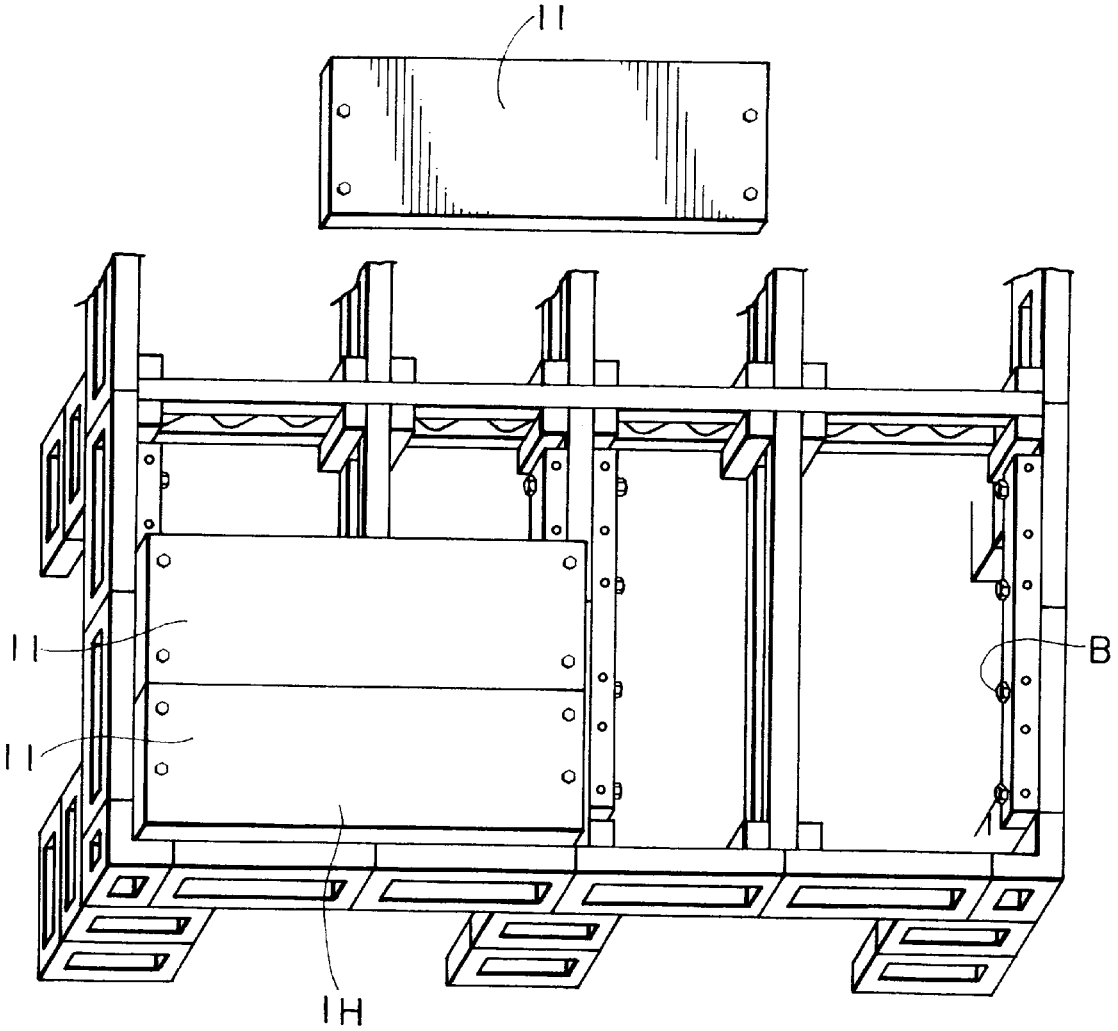
FIG. 15 is a partially cutaway enlarged sectional view showing a method of assembling a floor portion of a second floor for the modular structure of FIG. 9.

Thereafter, L-shaped blocks 4 and block structures 7 are connected to each other and to an upper surface of the wall face 1E for constructing the second floor of the building structure. The connected L-shaped blocks 7 define a crossbeam 1F of the second floor (FIGS. 9, 11, 13). Block structures 7 are then connected in tension to inner surfaces of the crossbeam 1F to form support beams 1G of the second floor (FIGS. 9, 13). Panel assemblies 11 are then connected to upper surfaces of the support beams 1G to form a floor 1H of the second floor (FIG. 15). Thereafter, using the floor 1H as a scaffold, I-shaped blocks 3 and L-shaped blocks 4 are then successively connected to each other and to the crossbeam 1F to form a wall face 1I of the second floor (FIG. 9). Again, T-shaped blocks 5 and X-shaped blocks 6 are utilized if the particular design of the building structure requires them.

Figure 16:
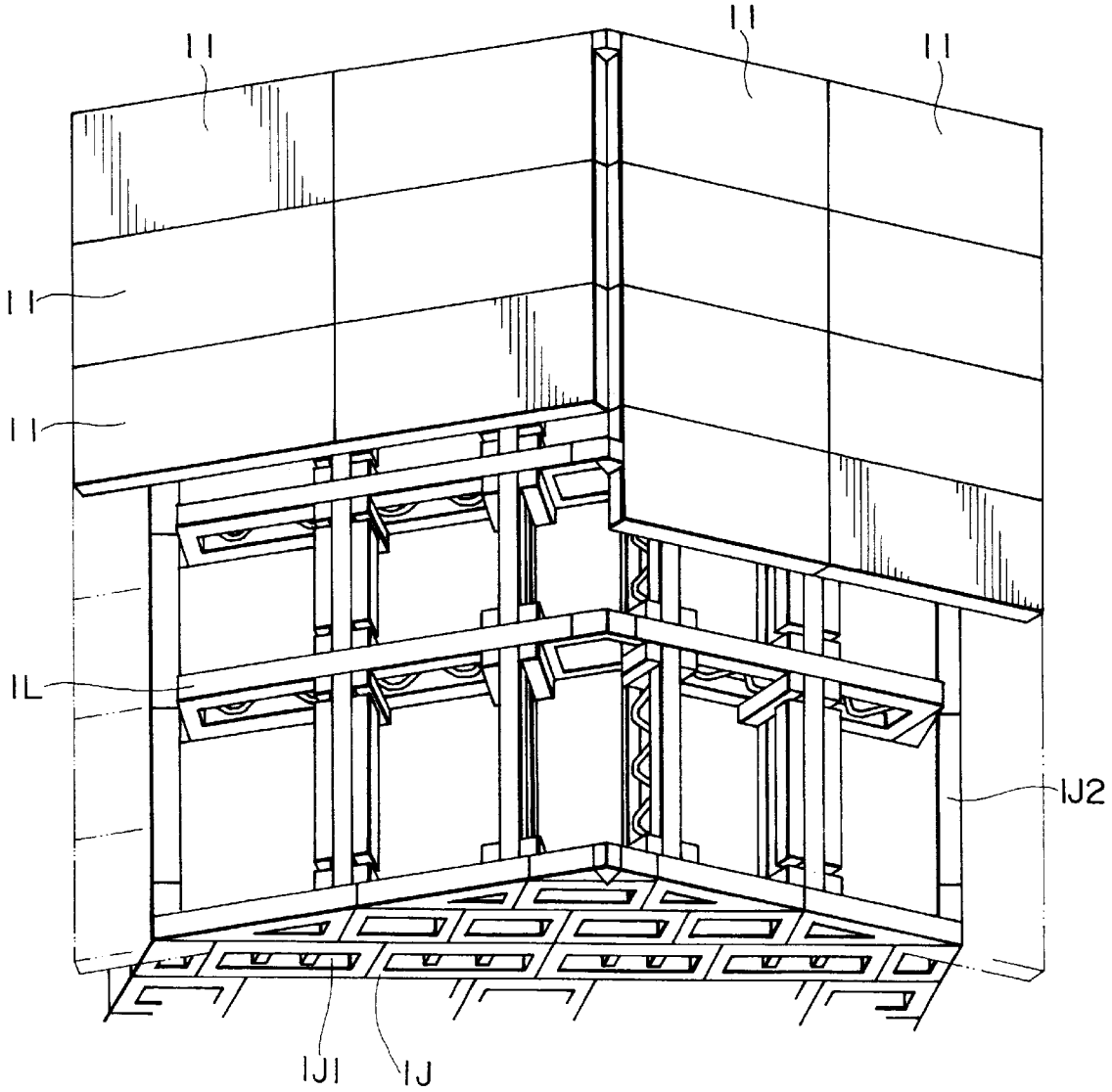
FIG. 16 is a partially cutaway enlarged sectional view showing a method of assembling a roof portion for the modular structure of FIG. 9.

L-shaped blocks 4 and block structures 7 are then successively connected to each other and to an upper surface of the wall face 1I to form a crossbeam assembly 1J of a roof floor comprising front and rear crossbeams 1J1 and right and left crossbeams 1J2 (FIGS. 9, 16). Thereafter, I-shaped blocks 3 and triangle blocks 12 are connected to each other and to upper surfaces of the front and rear crossbeams 1J1 to form front and rear gable walls 1K, respectively (FIG. 9).

As shown in FIG. 16, the roof truss block assemblies 9 described above are then connected in tension and in spaced relation thereof between the right and left crossbeams 1J2 to form roof trusses 1L. More specifically, one end of the truss units 9A of one of the roof truss block assemblies 9 is connected to the left crossbeam IJ2 and to the right crossbeam IJ2, respectively, with a connecting member 9E interposed therebetween as described above and shown in FIG. 10. The truss units 9A are then connected to one another as described above and shown in FIGS. 10 and 17.

Thereafter, block structures 7 are connected to and between adjacent roof truss block assemblies 9, and to and between the front and rear gable walls 1K and a respective adjacent roof truss block assembly 9. Lastly, panel assemblies 11 are connected to upper surfaces of the roof truss 1L to complete the roof 10 of the building structure.

FIGS. 24–31 illustrate a method for constructing a modular building structure 2 having a first floor, a second floor and a snow duct roof system. As shown in FIGS. 24 and 27–29, a foundation 2A preferably comprised of a suitable concrete material is prepared using conventional methods. A first floor of the building structure is then constructed by first disposing I-shaped blocks 3 and L-shaped blocks 4 on the foundation 2A and successively connecting the blocks to each other by means of any of the connecting assemblies described above to form a beam support portion 2B for supporting front, rear, left and right support beams 2C of the building structure. T-shaped blocks 5 and X-shaped blocks 6 are utilized if the particular design of the building structure requires them.

Figure 27:
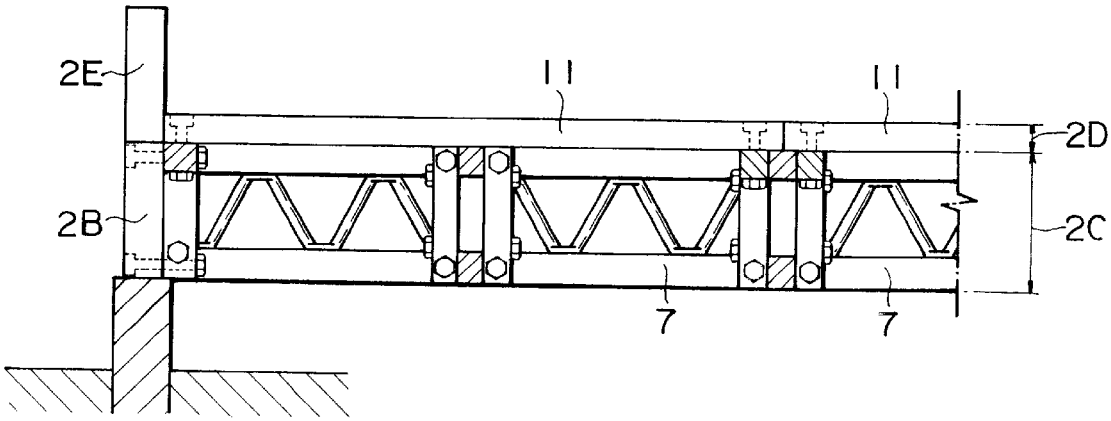
FIG. 27 is a partially cutaway enlarged sectional view taken along line 27—27 of FIG. 24.
Figure 28:
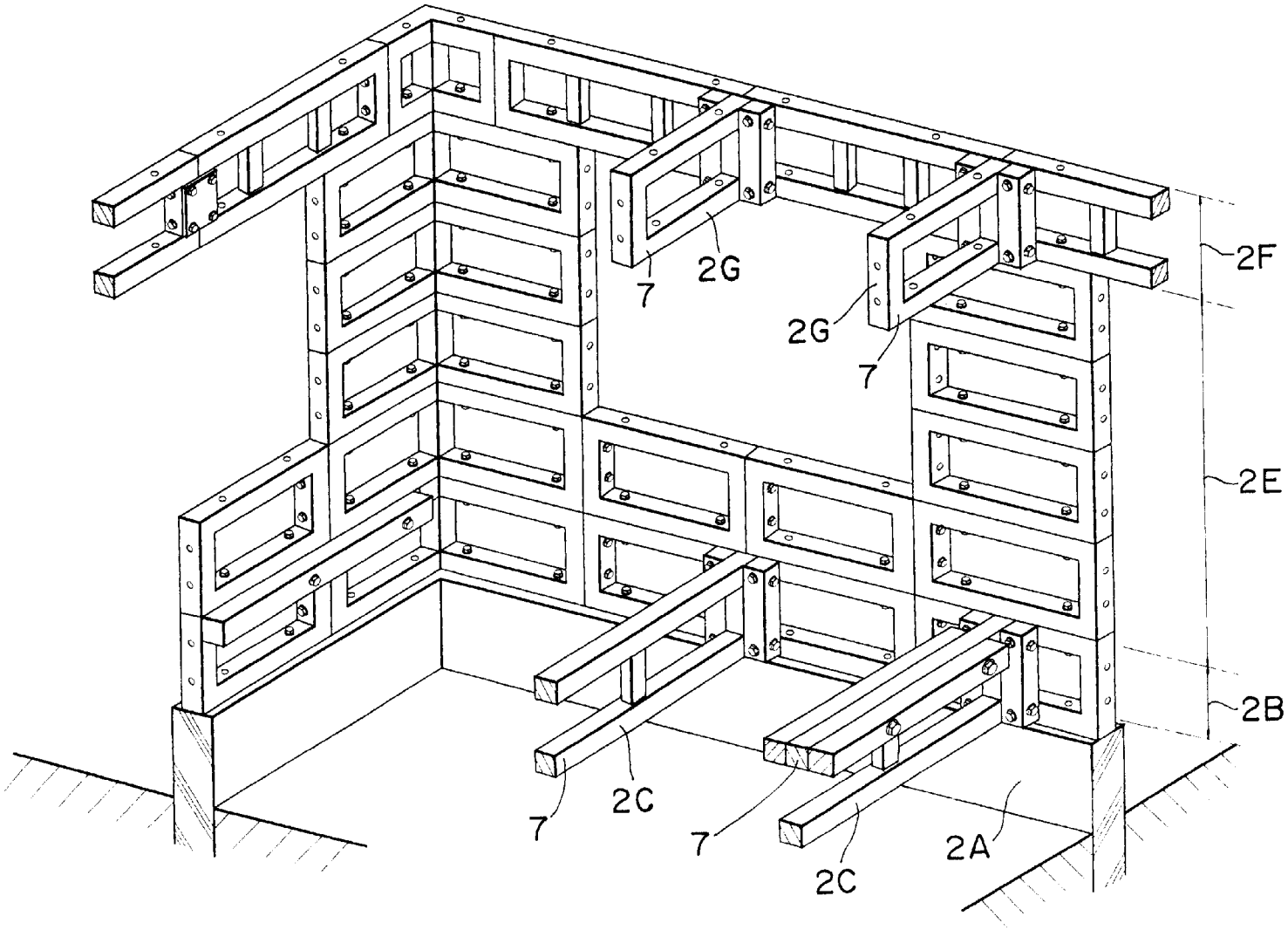
FIG. 28 is a partially cutaway perspective view showing a method of assembling wall, beam and crossbeam portions for the modular structure of FIG. 24.
Figure 29:
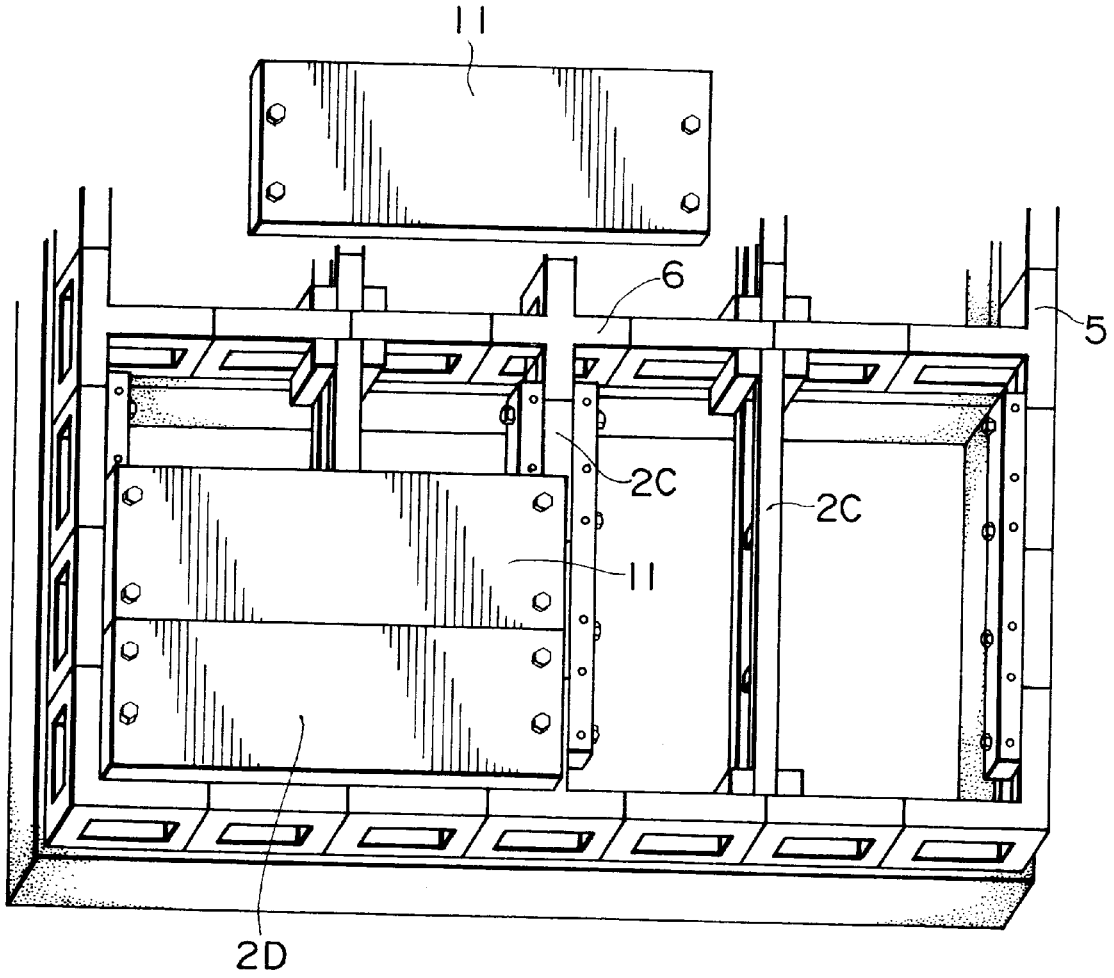
FIG. 29 is a partially cutaway perspective view showing a method of assembling a floor portion of a first floor for the modular structure of FIG. 24.

Block structures 7 are then connected in tension to inner surfaces of the beam support portion 2B using, for example, the connection assembly described above for the embodiment of FIGS. 21–22 to define the support beams 2C of the first floor. As shown in FIG. 27 and 29, panel assemblies 11 are then connected to upper surfaces of the support beams 2C to form a floor 2D of the first floor. Using the floor 2D as a scaffold, I-shaped blocks 3 and L-shaped blocks 4 are then successively connected to each other and to the beam support portion 2B of the first floor to form a wall face 2E of the first floor (FIGS. 24, 27, 28).

Figure 26:
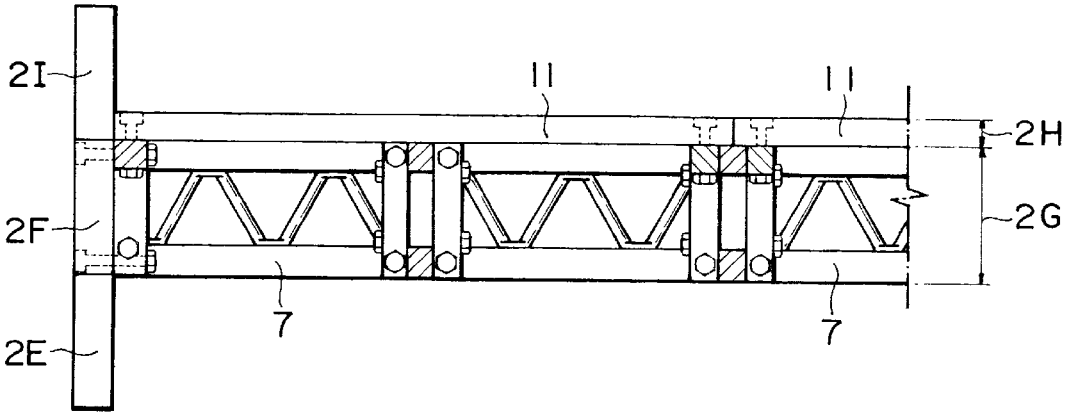
FIG. 26 is a partially cutaway enlarged sectional view taken along line 26—26 of FIG. 24.
Figure 30:
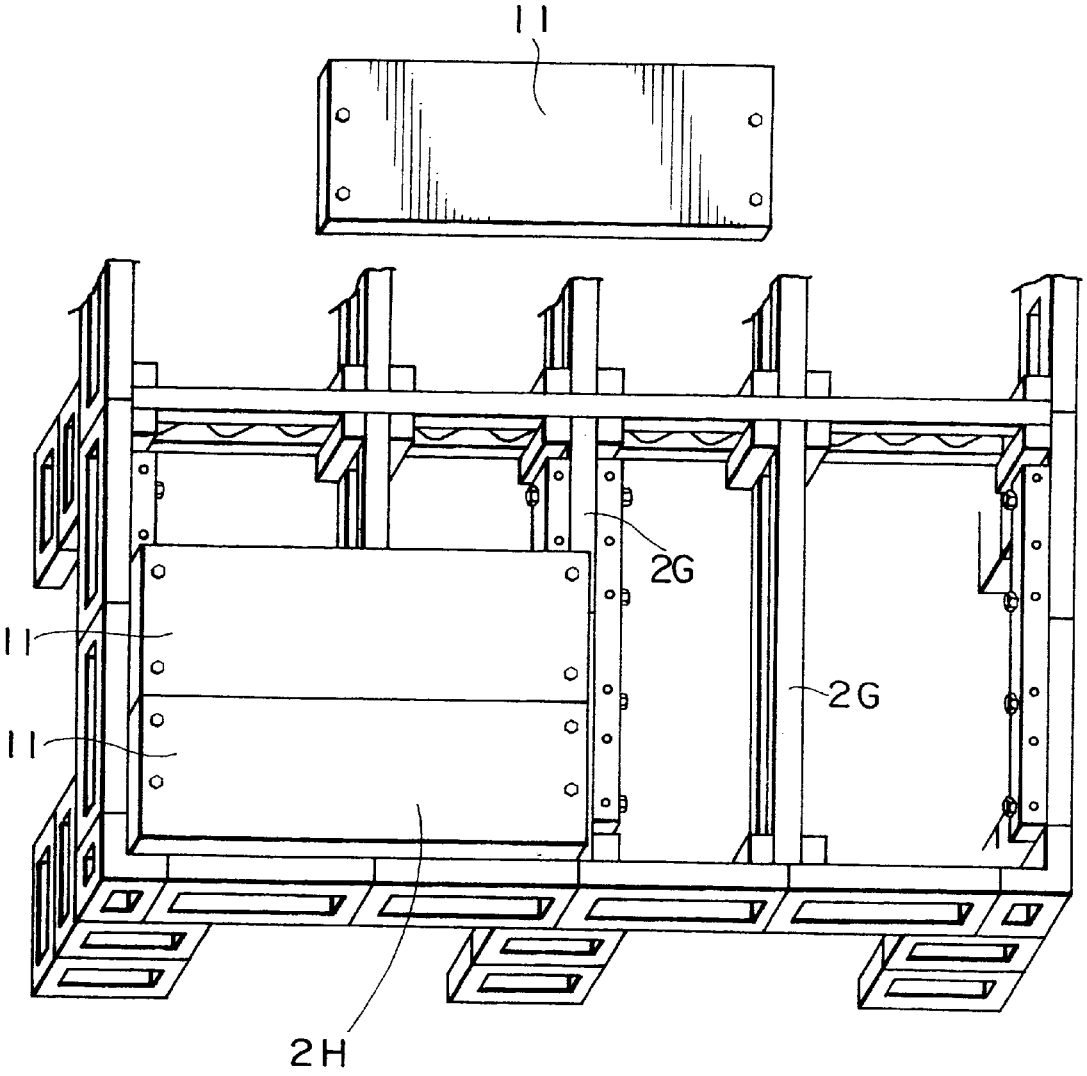
FIG. 30 is a partially cutaway perspective view showing a method of assembling a floor portion of a second floor for the modular structure of FIG. 24.
Figure 31:
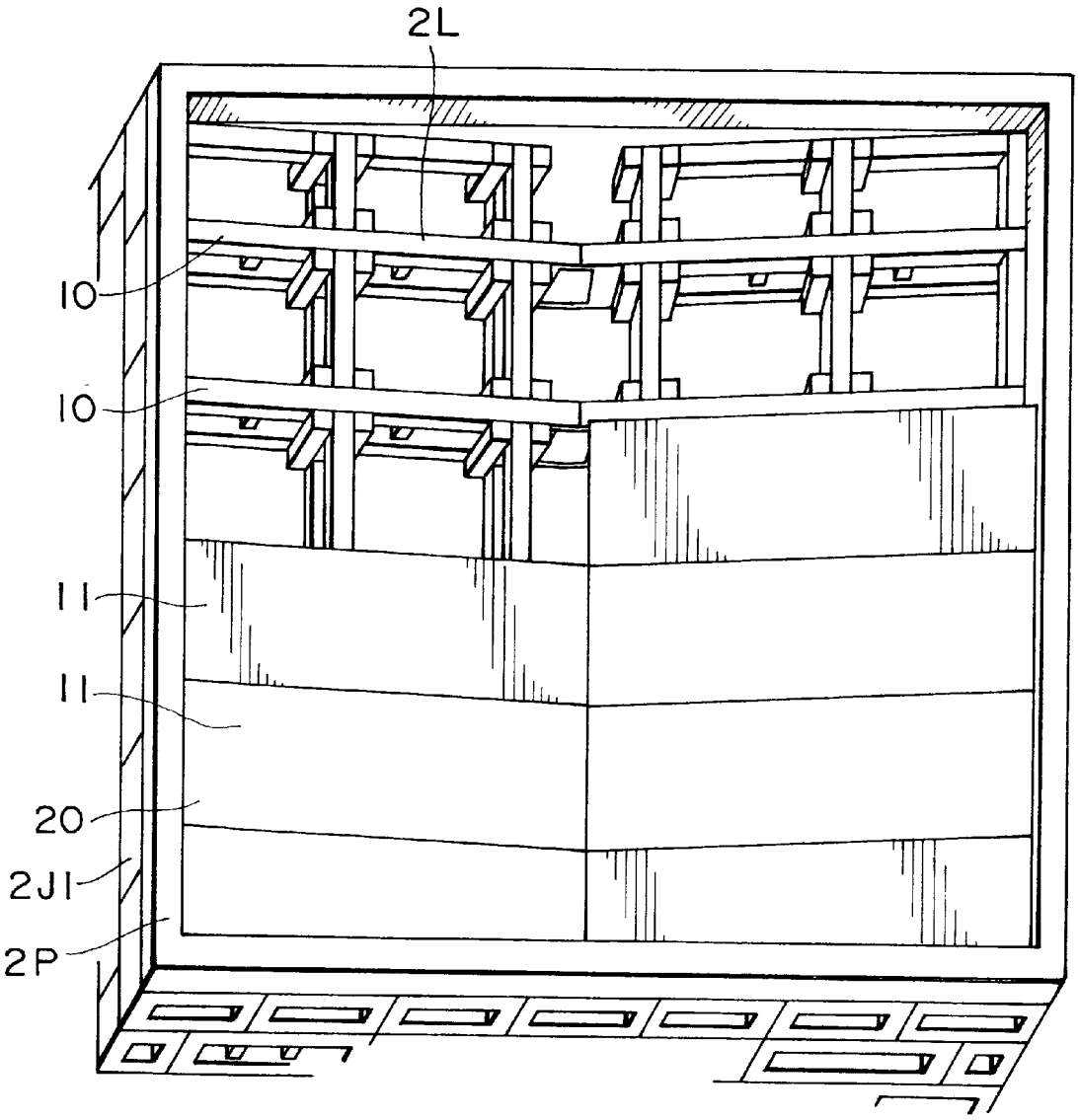
FIG. 31 is a partially cutaway perspective view showing a method of assembling a snow duct roof system.

Thereafter, L-shaped blocks 4 and block structures 7 are connected to each other and to an upper surface of the wall face 2E for constructing the second floor of the building structure. The connected L-shaped blocks 7 define a crossbeam 2F of the second floor (FIGS. 24, 26, 28). Block structures 7 are then connected in tension to inner surfaces of the crossbeam 2F to form support beams 2G of the second floor (FIGS. 24, 28). Panel assemblies 11 are then connected to upper surfaces of the support beams 2G to form a floor 2H of the second floor (FIG. 30). Thereafter, using the floor 2H as a scaffold, I-shaped blocks 3 and L-shaped blocks 4 are then successively connected to each other and to the crossbeam 2F to form a wall face 2I of the second floor (FIG. 24). L-shaped blocks 4 and block structures 7 are then successively connected to each other and to an upper surface of the wall face 2I to form a crossbeam assembly 2J of a roof floor comprising front, rear, right and left crossbeams 2J1 (FIGS. 24, 31). Again, T-shaped blocks 5 and X-shaped blocks 6 are utilized if the particular design of the building structure requires them.

As shown in FIG. 31, the roof truss block assemblies 10 described above are then connected in tension and in spaced relation between the right and left crossbeams 2J1 to form roof trusses 2L. More specifically, one end of the truss units 10A of one of the roof truss block assemblies 10 is connected to the right and left crossbeam 2J1, respectively, with a connecting member 10C interposed therebetween as described above and shown in FIG. 25. The truss units 10A are then connected to one another as described above and shown in FIGS. 25 and 32.

Thereafter, block structures 7 are connected to and between adjacent roof truss block assemblies 10. Panel assemblies 11 are then connected to upper surfaces of the roof truss 2L to complete the roof 20 of the building structure. Lastly, a parapet 2P is provided on an upper surface of the crossbeam 2J of the roof floor.

Although the foregoing construction methods according to the present invention have been described with reference to modular building structures, it is understood by those skilled in the art that the particular application to building structures and the configurations thereof shown are for illustrative purposes only and merely represent several of the multitude of different types of modular structures and configurations thereof that can be realized with the modular units of the present invention. Thus the present invention is in no way limited or restricted to the particular modular structures and configurations illustrated in the drawings.

For example, the modular units of the present invention may be secured together to form a suitable enclosure for various types of other uses, such storage facilities. They may be mounted on appropriate foundations of a base, which may for example, be the ground.

Moreover, as described above, each of the modular units is preferably comprised of a block structure (i.e., a structure having components formed of a solid material). Alternatively, the components of each modular unit according to the present invention may be hollow sections (e.g., box-shaped) preferably constructed from a suitable structural material as described above. The hollow sections may be filled, or at least partially filled, with a fairly rigid filler material, such as several known plastics, or the like. In addtion, several fairly rigid open-celled materials or foam materials, such as polyurethane, may be introduced into the hollow interior of the components.

The following advantages are achieved by the set of modular units, modular structures and construction methods of the present invention:

1. The modular units of the present invention can be readily assembled by amateur builders to provide modular structures capable of assuming nearly any shape or size.

2. The number of types of modular units for constructing a modular structure is small, thereby facilitating transportation, loading and unloading operations thereof.

3. The modular units have a configuration (e.g., open structure), size and weight which allows manipulation thereof (e.g., lifting) by one person without requiring the use of any special and/or complex machinery. Furthermore, the modular units may be assembled using a simple scaffold system.

4. The modular units can be connected to one another and to other components of a modular structure by a minimum number of simple connecting elements, such as threaded bolts and threaded nuts, thereby facilitating the construction of the modular structure without requiring special skills. Furthermore, only simple tools are required for assembly of the modular units (e.g., for fastening the threaded bolts and threaded nuts).

5. Since the modular units of the present invention are of uniform construction, connection thereof to one another is facilitated and can be accomplished in a relatively short period of time. More specifically, since the modular units are of uniform height, the members of the modular units have a uniform cross-section, and the connecting through-holes are uniformly located in all of the modular units (i.e., formed at the same locations), the connecting through-holes of the modular units can be automatically aligned by simply superimposing the connecting surfaces of the modular units to be connected. Thus the amount of time required to construct a modular structure utilizing the modular units of the present invention is substantially reduced as compared to conventional modular structure construction methods.

6. All of the operations for constructing a modular building structure using the modular units of the present invention, except for the construction of the roof, can be carried out safely from the inside of the building structure as it is being constructed. For example, after the floor of the first floor is laid, the first floor can be used as a scaffold and/or as a support surface for a simple scaffold structure for assembling the walls of the first floor. Similarly, after the floor of the second floor is laid, the second floor can be used as a scaffold and/or as a support surface for a simple scaffold structure for assembling the walls of the second floor and the roof floor.

7. The construction method of the present invention effectively reduces costly amounts of skilled and unskilled labor as well as the amount of construction time.

8. The modular units may be fabricated at a factory, for example, and may be transported for assembly on location by relatively unskilled labor to construct modular structures such as depicted in FIGS. 9 and 24.

9. The open structure construction of the modular units of the invention effectively reduces the overall weight of the modular units while providing an overall construction with inherent rigidity. The openings in each of the modular units define open spaces adaptable for receiving, for example, an insulating material during the construction of building structures.

From the foregoing description, it can be seen that the present invention comprises an improved modular construction system. It will be appreciated by those skilled the art that obvious changes could be made to the embodiments described in the foregoing description without departing from the broad inventive concept thereof. For example, although the foregoing set of modular units have been described and illustrated with a specific application to modular building structures, it will be appreciated that the foregoing set of modular units are also particularly well adapted for other types of modular structures, such as, for example, container structures and bridge structures. Additionally, the foregoing set of modular units may be assembled to construct modular structures having nearly any shape or size. It is understood, therefore, that this invention is not limited to the particular embodiments disclosed, but is intended to cover all modifications thereof which are within the scope and spirit of the invention as defined by the appended claims.

I claim:

1. A modular unit system for constructing a modular structure, the modular unit system comprising: a plurality of generally different modular unit sets each having a plurality of identical modular units, the modular units of each modular unit set having connecting surfaces each for connection to a corresponding connecting surface of at least one other identical modular unit or to a corresponding connecting surface of one of the modular units of another of the modular unit sets to construct a modular structure having a predetermined configuration, each modular unit of each modular unit set comprising at least one open quadrilateral section having a first pair of parallel, spaced-apart members and a second pair of parallel, spaced-apart members each having an end connected to an end of one of the first pair of members.

2. A modular unit system according to claim 1; wherein the modular units of all of the modular unit sets have the same height.

3. A modular unit system according to claim 1; wherein the modular units of four of the different modular unit sets respectively comprise blocks having a generally I-shaped outline, a generally L-shaped outline, a generally T-shaped outline and a generally X-shaped outline.

4. A modular unit system according to claim 3; wherein each modular unit of each modular unit set comprises a single piece of material.

5. A modular unit system according to claim 1; wherein the first and second members of each quadrilateral section have the same cross-sectional shape.

6. A modular unit system according to claim 5; wherein the first and second members of each quadrilateral section are generally square-shaped in cross-section.

7. A modular unit system according to claim 1; wherein each of the first and second members has a generally planar surface defining one of the connecting surfaces.

8. A modular unit system according to claim 1; wherein each of the first and second members comprises a solid piece of structural material.

9. A modular unit system according to claim 8; wherein the solid piece of material comprises wood.

10. A modular unit system according to claim 1; wherein each of the modular units of at least one of the modular units sets comprises a plurality of quadrilateral sections connected together in perpendicular relation thereto.

11. A modular unit system according to claim 1; wherein each modular unit of each modular unit set comprises a block.

12. A modular unit system according to claim 11; wherein each block is comprised of a wood material.

13. A modular unit system according to claim 11; wherein each block comprises a single piece of structural material.

14. A modular unit system according to claim 13; wherein the structural material comprises wood.

15. A modular unit system for constructing a modular structure, the modular unit system comprising: a plurality of generally different modular unit sets each having a plurality of identical modular units, each modular unit of each modular unit set comprising a single piece of wood and having connecting surfaces each for connection to a corresponding connecting surface of at least one other identical modular unit or to a corresponding connecting surface of one of the modular units of another of the modular unit sets to construct a modular structure having a predetermined configuration, the modular units of four of the different modular unit sets respectively comprising blocks having a generally I-shaped outline, a generally L-shaped outline, a generally T-shaped outline and a generally X-shaped outline.

16. A modular structure construction comprising: a plurality of generally different modular unit sets each having a plurality of identical modular units, the modular units of each modular unit set having connecting surfaces, and each modular unit of each modular unit set comprising at least one open quadrilateral section having a first pair of parallel, spaced-apart members and a second pair of parallel, spaced-apart members each having an end connected to an end of one of the first pair of members; and means interconnecting the connecting surfaces of each modular unit of each modular unit set to a corresponding connecting surface of at least one other identical modular unit or to a corresponding connecting surface of one of the modular units of another of the modular unit sets to define a modular structure.

17. A modular structure construction according to claim 16; wherein the modular structure comprises a building.

18. A modular structure construction according to claim 16; wherein the modular units of four of the different modular unit sets respectively comprise blocks having a generally I-shaped outline, a generally L-shaped outline, a generally T-shaped outline and a generally X-shaped outline.

19. A modular structure construction according to claim 16; wherein each modular unit of each modular unit set comprises a single piece of material.

20. A modular structure construction comprising: a plurality of generally different modular unit sets each having a plurality of identical modular units, each modular unit of each modular unit set comprising a single piece of wood and having connecting surfaces, the modular units of four of the different modular unit sets respectively comprising blocks having a generally I-shaped outline, a generally L-shaped outline, a generally T-shaped outline and a generally X-shaped outline; and means interconnecting the connecting surfaces of each modular unit of each modular unit set to a corresponding connecting surface of at least one other identical modular unit or to a corresponding connecting surface of one of the modular units of another of the modular unit sets to define a modular structure.

21. A building system comprising: a building having a foundation, a roof structure, a wall structure for supporting the roof structure, and a floor structure for supporting the wall structure on the foundation; wherein the roof structure, the wall structure and the floor structure comprise a plurality of generally different modular unit sets each having a plurality of identical modular units, the modular units of each modular unit set having connecting surfaces connected to a corresponding connecting surface of at least one other identical modular unit or to a corresponding connecting surface of one of the modular units of another of the modular unit sets to define the roof structure, the wall structure and the floor structure, each modular unit of each modular unit set comprising at least one open quadrilateral section having a first pair of parallel, spaced-apart members and a second pair of parallel, spaced-apart members each having an end connected to an end of one of the first pair of members.

22. A building system according to claim 21; wherein each modular unit of each modular unit set comprises a single piece of material.

23. A building system according to claim 22; wherein the single piece of material comprises wood.

24. A building system comprising: a building having a foundation, a roof structure, a wall structure for supporting the roof structure, and a floor structure for supporting the wall structure on the foundation; wherein the roof structure, the wall structure and the floor structure comprise a plurality of generally different modular unit sets each having a plurality of identical modular units, the modular units of each modular unit set having connecting surfaces connected to a corresponding connecting surface of at least one other identical modular unit or to a corresponding connecting surface of one of the modular units of another of the modular unit sets to define the roof structure, the wall structure and the floor structure, the modular units of four of the different modular unit sets respectively comprising blocks having a generally I-shaped outline, a generally L-shaped outline, a generally T-shaped outline and a generally X-shaped outline.

25. A building system according to claim 24; wherein each modular unit of each modular unit set comprises a single piece of material.

26. A building system according to claim 25; wherein the single piece of material comprises wood.

27. A method for constructing a building structure, comprising the steps of:

providing a plurality of generally different modular unit sets each having a plurality of identical modular units, the modular units of each modular unit set having connecting surfaces, and each modular unit of each modular unit set comprising at least one open quadrilateral section having a first pair of parallel, spaced-apart members and a second pair of parallel, spaced-apart members each having an end connected to an end of one of the first pair of members; and connecting the connecting surfaces of each modular unit of each modular unit set to a corresponding connecting surface of at least one other identical modular unit or to a corresponding connecting surface of one of the modular units of another of the modular unit sets to construct the modular building structure.

28. A method according to claim 27; wherein the modular units of four of the different modular unit sets respectively comprise blocks having a generally I-shaped outline, a generally L-shaped outline, a generally T-shaped outline and a generally X-shaped outline.

29. A method according to claim 28; wherein each modular unit of each modular unit set comprises a single piece of material.

30. A method for constructing a building structure, comprising the steps of:

providing a plurality of generally different modular unit sets each having a plurality of identical modular units. each modular unit of each modular unit set comprising a single piece of wood and having connecting surfaces, the modular units of four of the different modular unit sets respectively comprise blocks having a generally I-shaped outline, a generally L-shaped outline, a generally T-shaped outline and a generally X-shaped outline; and connecting the connecting surfaces of each modular unit of each modular unit set to a corresponding connecting surface of at least one other identical modular unit or to a corresponding connecting surface of one of the modular units of another of the modular unit sets to construct the modular building structure.

31. A modular unit system for constructing a modular structure, the modular unit system comprising: a plurality of generally different modular unit sets each having a plurality of identical modular units, each modular unit of each modular unit set consisting of a single piece of structural material and comprising at least one open quadrilateral section, each modular unit of each modular unit set having connecting surfaces each for connection to a corresponding connecting surface of at least one other identical modular unit or to a corresponding connecting surface of one of the modular units of another of the modular unit sets to construct a modular structure having a predetermined configuration.

32. A modular unit system according to claim 31; wherein the at least one open quadrilateral section of at least the modular units of one of the modular unit sets comprises a plurality of open quadrilateral sections.

33. A modular unit system according to claim 32; wherein the plurality of open quadrilateral sections are connected together in perpendicular relation thereto.

34. A modular unit system according to claim 31; wherein the structural material comprises wood.

35. In a modular structure construction, a modular unit system as claimed in claim 31 for constructing the modular structure construction having a preselected configuration.

36. In a building system, a modular unit system as claimed in claim 31 for constructing the building system having a preselected configuration.

* * * * *